US008870254B2

(12) United States Patent
Marshall, III

(10) Patent No.: US 8,870,254 B2
(45) Date of Patent: Oct. 28, 2014

(54) CHOPSTICKS UTENSIL

(76) Inventor: Edward E. Marshall, III, Huntingdon Valley, PA (US)

( * ) Notice: Subject to any disclaimer, the term of this patent is extended or adjusted under 35 U.S.C. 154(b) by 0 days.

(21) Appl. No.: 13/565,566

(22) Filed: Aug. 2, 2012

(65) Prior Publication Data

US 2013/0200643 A1 Aug. 8, 2013

Related U.S. Application Data

(60) Provisional application No. 61/514,229, filed on Aug. 2, 2011, provisional application No. 61/551,098, filed on Oct. 25, 2011.

(51) Int. Cl.

| | |
|---|---|
| ***B25B 7/00*** | (2006.01) |
| ***B25B 9/00*** | (2006.01) |
| ***A47G 21/10*** | (2006.01) |
| ***A47G 21/06*** | (2006.01) |

(52) U.S. Cl.

CPC ..... *A47G 21/103* (2013.01); *A47G 2400/025* (2013.01); *A47G 21/10* (2013.01)

USPC ..... 294/99.2

(58) Field of Classification Search

USPC ..... 294/99.2, 16, 218, 219, 3, 33, 28, 106; 606/210, 211; D7/393, 686; D24/143

See application file for complete search history.

(56) References Cited

U.S. PATENT DOCUMENTS

| | | | | |
|---|---|---|---|---|
| 211,855 | A * | 2/1879 | Kinzer | 294/11 |
| 389,925 | A * | 9/1888 | Griscom | 294/106 |
| 1,765,974 | A | 6/1930 | Foltis | |
| 2,647,006 | A | 7/1953 | Coyle | |
| 2,711,339 | A | 6/1955 | McGogy | |
| 2,803,252 | A | 8/1957 | Bloome | |
| 2,997,328 | A | 8/1961 | Lee | |
| 3,186,749 | A | 6/1965 | Dawes | |
| 3,280,665 | A * | 10/1966 | Block | 294/99.2 |
| 3,304,111 | A | 2/1967 | Kauh et al. | |
| 3,323,825 | A | 6/1967 | Arima | |
| 3,414,310 | A | 12/1968 | Ono | |
| 3,501,191 | A | 3/1970 | Darr | |
| 3,559,515 | A * | 2/1971 | Skyser | 81/427 |
| 3,637,248 | A | 1/1972 | Arita | |
| 3,884,456 | A | 5/1975 | Lew | |

(Continued)

FOREIGN PATENT DOCUMENTS

| | | | |
|---|---|---|---|
| CN | 2783885 | Y | 5/2006 |
| CN | 200963045 | Y | 10/2007 |

(Continued)

*Primary Examiner* — Stephen Vu

(74) *Attorney, Agent, or Firm* — Belles Katz LLC

(57) ABSTRACT

A self-supporting chopsticks utensil. In one aspect, the utensil includes: a base comprising: a first body having a first bottom surface; and a second body having a second bottom surface, the second body rotatably coupled to the first body, the first and second bottom surfaces collectively defining a support plane; a first elongated rod extending from the first body and terminating in a first distal portion; a second elongated rod extending from the second body and terminating in a second distal portion; and wherein the utensil is weighted to be self-standing so that when the support plane is positioned atop a substantially horizontal support surface, each of the first and second distal portions of the first and second rods are maintained a distance above the substantially horizontal support surface.

14 Claims, 20 Drawing Sheets

(56) References Cited

U.S. PATENT DOCUMENTS

| | | | |
|---|---|---|---|
| 3,937,510 | A | 2/1976 | Lew |
| 4,261,608 | A | 4/1981 | Bradshaw |
| 4,312,530 | A | 1/1982 | Young |
| 4,523,781 | A | 6/1985 | Brody |
| 4,576,408 | A | 3/1986 | Maneki |
| D283,192 | S | 4/1986 | Kono |
| 4,659,128 | A | 4/1987 | Dong |
| 4,707,922 | A | 11/1987 | Hosak-Robb |
| 4,721,334 | A | 1/1988 | Nakatsu |
| 4,787,663 | A | 11/1988 | Laramie |
| 4,826,227 | A | 5/1989 | Lew |
| 4,852,929 | A | 8/1989 | Shafir |
| D311,851 | S | 11/1990 | Allardyce |
| 4,973,095 | A | 11/1990 | Kunihisa |
| 5,056,841 | A | 10/1991 | Yong |
| 5,277,464 | A | 1/1994 | Okun |
| 5,431,465 | A | 7/1995 | Shibata |
| 5,486,029 | A | 1/1996 | Kobayashi |
| 5,649,728 | A | 7/1997 | Warthen |
| 5,810,411 | A | 9/1998 | Major |
| 5,911,462 | A | 6/1999 | Hui |
| 6,217,092 | B1 | 4/2001 | Spicker |
| D445,312 | S | 7/2001 | Shulman |
| 6,276,734 | B1 | 8/2001 | Krieger |
| D448,627 | S | 10/2001 | Chan |
| 6,402,214 | B1 | 6/2002 | Weiner |
| D463,220 | S | 9/2002 | Yun |
| 6,454,328 | B1 | 9/2002 | Barillos |
| 6,547,296 | B1 | 4/2003 | Perkitny et al. |
| 6,581,997 | B1 | 6/2003 | Martikainen et al. |
| 6,749,239 | B2 | 6/2004 | Choi |
| D499,311 | S | 12/2004 | Chen |
| 7,017,964 | B2 | 3/2006 | Hao |
| 7,052,061 | B2 | 5/2006 | Calagui |
| 7,182,378 | B2 | 2/2007 | Inomata et al. |
| 7,216,910 | B2 | 5/2007 | Frauscher |
| 7,234,745 | B1 | 6/2007 | Tsai |
| 7,448,660 | B2 | 11/2008 | Yamanaka et al. |
| 7,770,950 | B1 | 8/2010 | Liu |
| 7,878,563 | B2 | 2/2011 | Beckham et al. |
| 2002/0096898 | A1 | 7/2002 | Kang |
| 2003/0197390 | A1 | 10/2003 | Choi et al. |
| 2004/0164573 | A1 | 8/2004 | Hao |
| 2005/0082855 | A1 | 4/2005 | Baxter |
| 2005/0099031 | A1 | 5/2005 | Park |
| 2005/0134065 | A1 | 6/2005 | Inomata et al. |
| 2005/0269825 | A1 | 12/2005 | Lee |
| 2006/0157996 | A1 | 7/2006 | McRorie, III et al. |
| 2006/0170229 | A1 | 8/2006 | Raeder et al. |
| 2007/0006465 | A1 | 1/2007 | Lee |
| 2008/0022534 | A1 | 1/2008 | Kim |
| 2008/0224490 | A1 | 9/2008 | Ina |
| 2009/0108600 | A1 | 4/2009 | Ichinose |
| 2009/0165307 | A1 | 7/2009 | Lam et al. |
| 2009/0167040 | A1 | 7/2009 | Tong et al. |
| 2009/0250956 | A1 | 10/2009 | Resnick |
| 2009/0278364 | A1 | 11/2009 | Beckham et al. |
| 2009/0284031 | A1 | 11/2009 | Pavicsits et al. |
| 2009/0322108 | A1 | 12/2009 | Bina |
| 2010/0013254 | A1 | 1/2010 | Lai Martinez |
| 2010/0049243 | A1 | 2/2010 | Luh |
| 2010/0052347 | A1 | 3/2010 | Teng |
| 2010/0164242 | A1 | 7/2010 | Bjorlund |
| 2010/0301620 | A1 | 12/2010 | Tow |
| 2011/0127787 | A1 | 6/2011 | Gosai |

FOREIGN PATENT DOCUMENTS

| | | | |
|---|---|---|---|
| CN | 200963046 | Y | 10/2007 |
| CN | 101099629 | A | 1/2008 |
| CN | 2014468855 | U | 5/2010 |
| CN | 201519001 | U | 7/2010 |
| CN | 201564187 | U | 9/2010 |
| CN | 201630875 | U | 11/2010 |
| CN | 201700930 | U | 1/2011 |
| DE | 3733937 | | 4/1989 |
| GB | 2333691 | | 4/1999 |
| TW | M393252 | Y | 12/2010 |
| WO | 2007007425 | | 1/2007 |

* cited by examiner

CHOPSTICKS UTENSIL

CROSS-REFERENCE TO RELATED APPLICATION

The present application claims the benefit of U.S. Provisional Patent Application Ser. No. 61/514,229, filed Aug. 2, 2011, and U.S. Provisional Patent Application Ser. No. 61/551,098, filed Oct. 25, 2011, the entireties of which are hereby incorporated by reference.

FIELD OF THE INVENTION

The present invention relates generally to a utensil, and more specifically to self-supporting chopsticks that are rotatably coupled together.

BACKGROUND OF THE INVENTION

Chopsticks are the principle utensil for eating and preparing food throughout most of Asia. The use of chopsticks can be traced back nearly five thousand years. In many Asian countries, children learn to use chopsticks at a very young age and are generally adept with their use. However, most Westerners use chopsticks infrequently, and are therefore consequently less proficient. Due to the rarity with which most Westerners use chopsticks, many have difficulty using them effectively when it is desirable to do so, such as when enjoying a meal at an Asian restaurant. One major reason for this difficulty is the complicated nature in which chopsticks are operated. Another reason for this difficulty is the relative small size of the distal gripping ends of conventional chopsticks, which makes it difficult for persons without sufficient practice to grip and manipulate portions of food.

The design of traditional chopsticks requires that they be laid down either on a plate, table or separate chopstick rest during periods of non-use. This practice leads to issues of cleanliness in that dirt and other bacteria from the plate, table or chopstick rest can penetrate the chopsticks, which are then put into the user's mouth. Further, picking up chopsticks after they are set down can be cumbersome due to their small surfaces.

Furthermore, elderly people and people who have decreased dexterity in their hands due to arthritis and other similar condition; have a difficult time operating traditional silverware such as forks, spoons and knives. Specifically, it can be difficult for people with dexterity loss in their hands to manipulate a fork so as to fill the fork with food, and then bring the fork to their mouths with the food still on the fork.

Therefore, there is a need for an enhanced version of the traditional chopsticks that is easier to handle and control. There is also a need for a chopstick utensil that is capable of grasping large portions of food in a secure manner. Finally, there is a need for a chopstick utensil that can stand freely, without the requirement of a separate chopstick rest.

SUMMARY OF THE INVENTION

These and other needs are met by the present invention, which is directed to a utensil, such as chopsticks, that can be easily used by persons who are inexperienced in chopstick use. In one aspect, the invention can be a utensil comprising: a base comprising: a first block having a first bottom surface; a second block having a second bottom surface, the first and second bottom surfaces collectively defining a support plane; and a hinge rotatably coupling the first and second blocks together for rotation about an axis of rotation, the axis of rotation extending substantially perpendicular to the support plane; a first elongated rod extending from the first block and terminating in a first distal portion; a second elongated rod extending from the second block and terminating in a second distal portion; and wherein the utensil is weighted to be self-standing so that when the support plane is positioned atop a substantially horizontal support surface, each of the first and second distal portions of the first and second elongated rods are maintained a distance above the substantially horizontal support surface.

In another aspect, the invention can be a utensil comprising: a base comprising: a first body having a first bottom surface; and a second body having a second bottom surface, the second body rotatably coupled to the first body, the first and second bottom surfaces collectively defining a support plane; a first elongated rod extending from the first body and terminating in a first distal portion; a second elongated rod extending from the second body and terminating in a second distal portion; and wherein the utensil is weighted to be self-standing so that when the support plane is positioned atop a substantially horizontal support surface, each of the first and second distal portions of the first and second rods are maintained a distance above the substantially horizontal support surface.

In yet another aspect, the invention can be a utensil comprising: a base comprising: a first block having a first bottom surface; and a second block having a second bottom surface, the second block rotatably coupled to the first block, and the first and second bottom surfaces collectively defining a support plane; a first elongated rod extending from the first block along a first rod axis; a second elongated rod extending from the second block along a second rod axis; the first and second rod axes extending at an oblique angle relative to the support plane; and wherein the utensil is weighted to be self-standing so that when the support plane is positioned atop a substantially horizontal support surface, no portion of the first and second elongated rods is in contact with the substantially horizontal support surface.

In still another aspect, the invention can be a utensil comprising: a base comprising: a first body; and a second body; a first elongated rod extending from the first body; a second elongated rod extending from the second body; wherein the second body is rotatably coupled to the first body so as to be rotatable about an axis of rotation, the axis of rotation extending along a y-axis of a Cartesian coordinate system; and wherein the first elongated rod extends along a first rod axis and the second elongated rod extending along a second rod axis, each of the first and second rod axes extending at an angle that is oblique to an x-z plane, an x-y plane and an y-z plane of the Cartesian coordinate system.

In a further aspect, the invention can be a utensil comprising: a base comprising: a first bulbous body; and a second bulbous body, wherein the first bulbous body is rotatably coupled to the second bulbous body, the first and second bulbous bodies collectively forming a truncated ovoid; a first elongated rod extending from the first body and terminating in a first distal end; and a second elongated rod extending from the second body and terminating in a second distal end.

In a still further aspect, the invention can be a utensil comprising: a base comprising: a first block having a first bottom surface; a second block having a second bottom surface, the first and second bottom surfaces collectively defining a support plane that is substantially coplanar with an x-z plane of a Cartesian coordinate system; and a hinge rotatably coupling the first and second blocks together for rotation about an axis of rotation, the axis of rotation extending at a first oblique angle to an x-z plane of the Cartesian coordinate system; a first elongated rod extending from the first block alone a first rod axis; a second elongated rod extending from the second block along a second rod axis; and the first and second axes extending at a second oblique angle to the x-z plane of the Cartesian coordinate system; and the elongated rods located on a first side of the x-z plane and the hinge located one a second side of the x-z plane opposite the first side.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
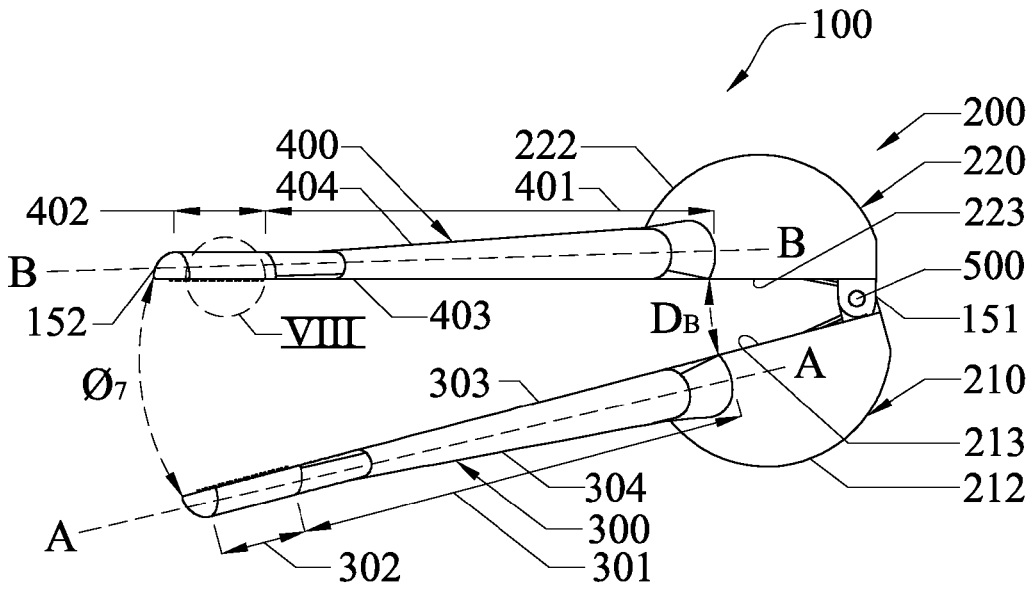
FIG. 1 is a top view of a utensil in an open position according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
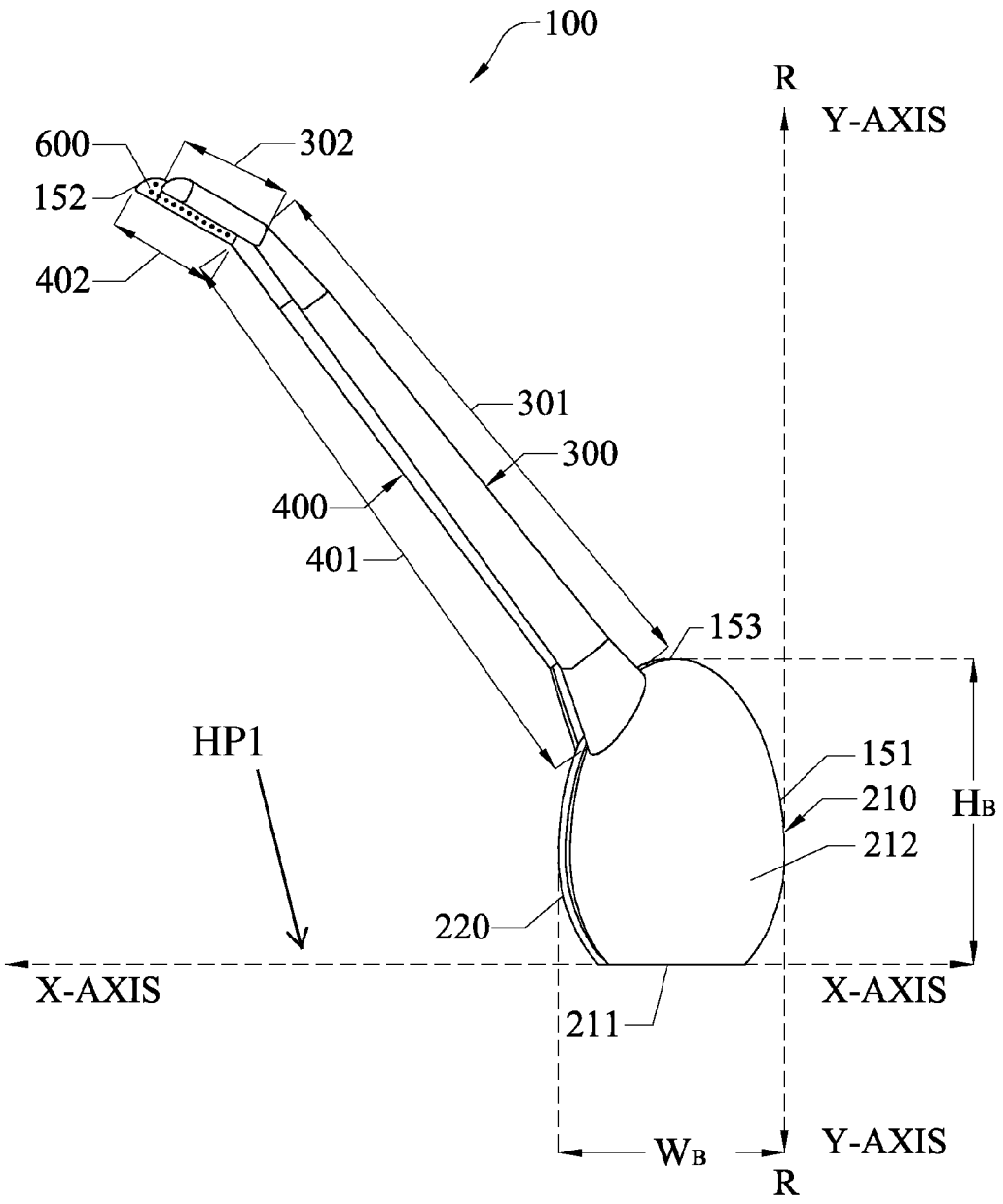
FIG. 2 is a side view of the utensil of FIG. 1 positioned along an X-Y plane of a three-dimensional Cartesian coordinate system.
Figure 3:
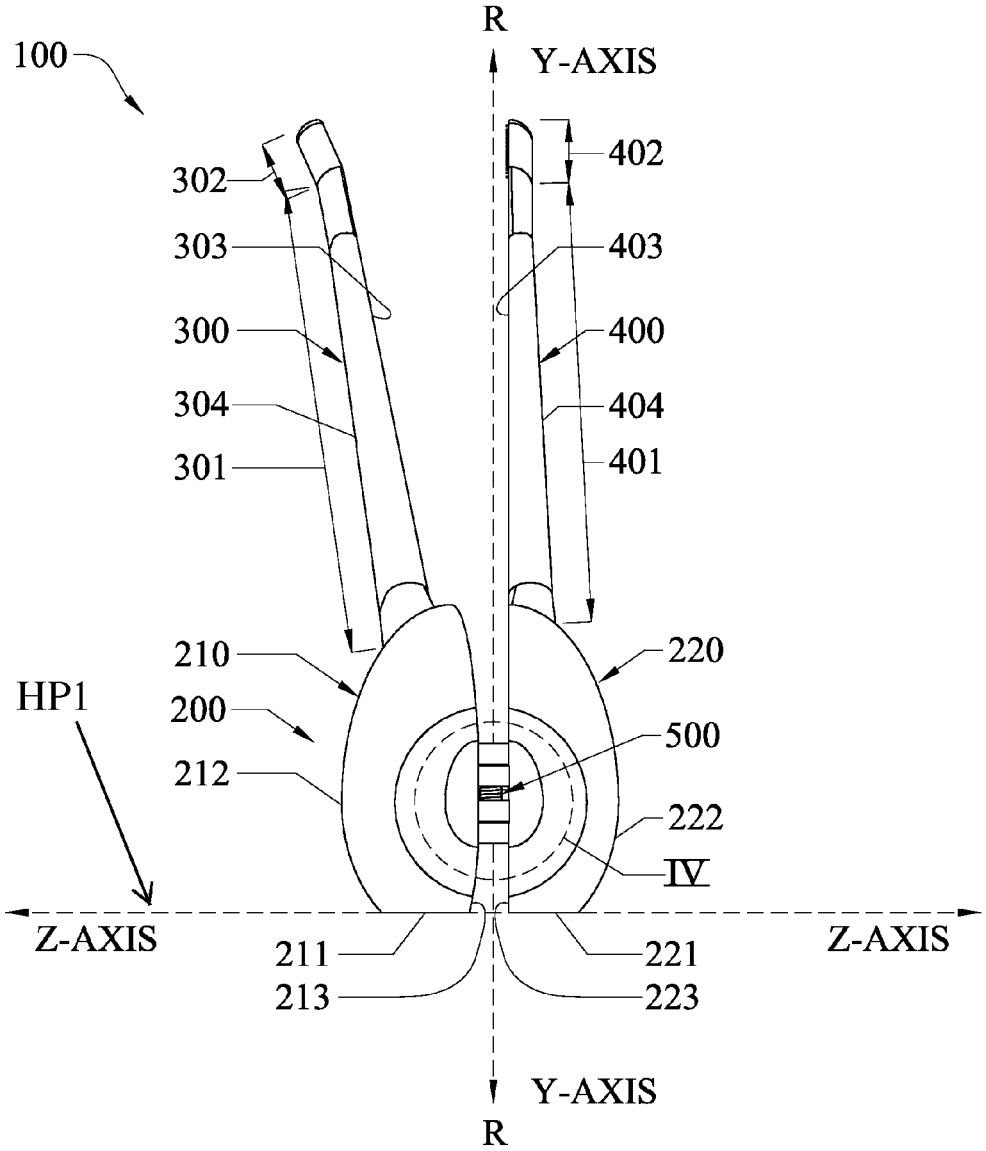
FIG. 3 is a rear view of the utensil of FIG. 1 positioned along a Z-Y plane of the three-dimensional Cartesian coordinate system.

Referring first to FIGS. 1-3 concurrently, a utensil 100 in accordance with an embodiment of the present invention is illustrated. The utensil 100 extends from a proximal-most end 151 to a distal-most end 152. The utensil 100 comprises a base 200, a first elongated rod 300, and a second elongated rod 400. The utensil 100 may be referred to herein as chopsticks or a chopstick utensil in certain embodiments because the utensil 100 may be considered a variation on or an improvement of traditional chopsticks. However, the invention is not particularly limited to being used as chopsticks and can be used as a generic utensil. The base 200 facilitates user manipulation of the utensil 100 and the First and second elongated rods 300, 400 facilitate gripping food products or other objects.

The base 200 of the utensil 100 comprises a first body 210 and a second body 220 that are rotatably coupled together. The first elongated rod 300 extends from the first body 210 and the second elongated rod 400 extends from the second body 220. The first body 210 comprises a first bottom surface 211, a First outer surface 212 and a first inner surface 213. Similarly, the second body 220 comprises a second bottom surface 221, a second outer surface 222, and a second inner surface 223. In the exemplified embodiment, the first and second bodies 210, 220 are substantially mirror images of one another. However, the invention is not so limited in all embodiments and in certain other embodiments the first and second bodies 210, 220 may be differently shaped for various reasons, such as to be more ergonomic for a person who is left-handed or right-handed or to be more comfortable for users with varying hand size.

In the exemplified embodiment, the first and second bodies 210, 220 are non-unitary, separate and distinct structures that are rotatably coupled together as noted above and discussed in more detail below with regard to FIGS. 4 and 9. However, the invention is not so limited in all embodiments and in certain other embodiments, the first and second bodies 210, 220 may be integrally formed as a single unitary structure. Further, in the exemplified embodiment both the first and second bodies 210, 220 are made of a dishwasher-safe, FDA-approved thermoplastic (e.g. Acrylonitrile Butadiene Styrene (ABS)), Nylon, or glass fill. Of course, the invention is not limited to forming the first and second bodies 210, 220 from one of the above-named materials in all embodiments and in certain other embodiments other materials may be used as desired. Moreover, the invention is not limited to the first and second bodies 210, 220 being formed of the same material in all embodiments, and in other embodiments each of the first and second bodies 210, 220 may be formed of different materials.

In the exemplified embodiment of the present invention, the first and second bottom surfaces 211, 221 are substantially planar surfaces. Thus, the first and second bottom surfaces 211, 221 are substantially flat. Moreover, in the exemplified embodiment, the first and second bottom surfaces 211, 221 are substantially coplanar with one another. As discussed in more detail below, forming the first and second bottom surfaces 211, 221 so as to be substantially coplanar enables the utensil 100 to be self-standing upon a substantially horizontal support surface HP1. Nonetheless, it should be understood that the invention is not so limited in all embodiments, and in alternate embodiments the first and second bottom surfaces 211, 221 may be oblique with respect to one another and/or may comprise undulations, cavities or inward indentations.

In the exemplified embodiment of the present invention, the first and second bottom surfaces 211, 221 collectively define a support plane for the utensil 100, such that the utensil 100 may rest on the first and second bottom surfaces 211, 221 in an upright and sell standing position. As discussed in more detail below, the upright and self-standing position enables the first and second bottom surfaces 211, 221 to rest atop and be in contact with a substantially planar support surface, such as a table top (not illustrated), while maintaining the first and second elongated rods 300, 400 at a distance above the substantially planar support surface. In the exemplified embodiment, the utensil 100 is self-standing so that when the first and second bottom surfaces 211, 221 of the utensil 100 are positioned atop the substantially horizontal support surface, no portion of the first and second elongated rods 300, 400 is in contact with the substantially horizontal support surface. In certain embodiments, in order to achieve the self-standing position, the utensil 100 is weighted in a manner such that the center of gravity of the utensil 100 resides over the base 200 so that the utensil 100 is supported upon its support plane. In such embodiments, failure to weight the base 200 would potentially cause the utensil 100 to tip over rather than enabling it to maintain its upright and self-standing position atop of a substantially planar support surface as a result of the weight of the elongated rods 300, 400.

The self-standing nature of the utensil 100 described above facilitates prevention of dirt or other bacteria from contacting portions of the utensil 100 that may either be handled by a user, such as the first and second bodies 210, 220, or portions of the utensil 100 that may be placed in a user's mouth during use, such as the first and second elongated rods 300, 400. Specifically, the self-standing nature of the utensil 100 eliminates the need to lean the first and second elongated rods 300, 400 against the user's plate, a chopstick rest or the table top by maintaining the first and second elongated rods 300, 400 at a distance above the substantially horizontal support surface (i.e., the tabletop). Thus, the first and second elongated rods 300, 400 of the utensil 100 are maintained off of the table, chopstick rest, plate or other substantially horizontal support surface even when the utensil 100 is not in use. Further, the utensil 100 may be retrieved and put into use more quickly and easily than other utensils, such as traditional chopsticks, forks, spoons or the like that must be laid down during periods of non-use.

The weighting of the utensil 100 of the present invention may be accomplished by various methods, such as, for example without limitation, using heavier materials for the base 200 (or a portion of the base 200) as compared with the elongated rods 300, 400 (e.g., forming the base 200 or a portion of the base 200 out of a metal or dense plastic material and forming the elongated rods 300, 400 out of a light-weight plastic material) or disposing a weighted substance (fluidic or other material) within the base 200. For example, in certain embodiments the first and second bodies 210, 220 may be formed as hollow bodies. In such embodiments, the first and second bodies 210, 220 may comprise a removable and re-sealable seal, cap or plate by which a weighted substance (fluidic or otherwise) may be introduced into and sealed within the first and second bodies 210, 220 so to provide the base 200 with the appropriate weight to stand upright. Fluidic substances include but are not limited to liquids (e.g., water), solid particles (e.g., sand), gasses and plasmas. Moreover, the invention is not to be limited by the particular method used to weight the utensil 100 in all embodiments and in certain other embodiments other means for configuring the utensil 100 so that it stands upright when its support plane rests on a substantially horizontal surface may be used as desired. Furthermore, in certain embodiments there will be no need to weight the base 200 of the utensil 100 and the utensil 100 will be self-supporting without such weight due to the structural arrangement of the elongated rods 300, 400 relative to the base 200.

Referring to FIGS. 1, 3, 6 and 7 concurrently, the first and second inner surfaces 213, 223 of the first and second bodies 210, 220 are substantially flat, planar surfaces that substantially oppose one another. As discussed in more detail below, this allows for the utensil 100 to open and close in order to grasp food or other objects between the first and second elongated rods 300, 400. Further, in certain embodiments, the first and second inner surfaces 213, 223 are substantially perpendicular to the support plane of the utensil 100. However, the invention is not so limited in all embodiments and in alternate embodiments, the first and second inner surfaces 213, 223 may comprise undulations, cavities or indentations.

Referring again to FIGS. 1-3 concurrently, in the exemplified embodiment the first and second outer surfaces 212, 222 of the first and second bodies 210, 220 are convex or dome-like in shape. Therefore, when viewed together, the first and second bodies 210, 220 are substantially bulbous or ovoid in shape. The shape of the first and second outer surfaces 212, 222 in the exemplified embodiment aids in the ergonomics of the utensil 100 and makes it easier and more comfortable for a user to handle the utensil 100 during eating. Of course, the invention is not to be limited to the particular shapes discussed above in all embodiments, and in certain other embodiments the first and second outer surfaces 212, 222 can take on other shapes, such as being rectangular or circular, or having undulations or recesses.

Although the first and second outer surfaces 212, 222 of the exemplified embodiment are mirror images of one another, the first and second outer surfaces 212, 222 in alternate embodiments may be contoured differently. Moreover, it should be noted that in certain other embodiments, the first and second outer surfaces 212, 222 may be any other shape that is suitable to be gripped by a human hand. Specifically, the first and second outer surfaces 212, 222 can be formed with undulations or grooves that correspond to a user's fingers. Further, although not limited thereto in all embodiments, in the exemplified embodiment the base 200 formed by the first and second bulbous bodies 210, 220 collectively, is a truncated ovoid, which allows the utensil 100 to be both self-supporting and ergonomic. More specifically, the base 200 is truncated at the first and second bottom surfaces 211, 221 of the first and second bodies 210, 220 to form the truncated ovoid shape. As stated above, it should be understood that the invention is not limited to the shape or size of the base 200 in all embodiments.

Turning to the size of the base 200, the base has a height $H_B$ and a width $W_B$. In the exemplified embodiment, the height $H_B$ of the base 200 is between 2.5 cm and 21 cm. In certain other embodiments, the height $H_B$ of the base 200 is between 5 cm and 13 cm, and in still other embodiments the height $H_B$ of the base 200 is between 6.3 cm and 8.9 cm. Further, in the exemplified embodiment the width $W_B$ of the base 200 is between 1.2 cm and 15.3 cm. In certain other embodiments, the width $W_B$ of the base 200 is between 2.5 cm and 10.2 cm, and in still other embodiments the width $W_B$ of the base 200 is between 3.8 cm and 6.4 cm. It should be understood that the invention is not to be so limited in all embodiments and in alternate embodiments the base may take on shapes and/or sizes outside of the above-recited ranges.

In certain embodiments, each of the first and second bodies 210, 220 is formed as a block. In such embodiments, the first and second bodies 210, 220 are substantially bulbous blocks, such that the base 200 is substantially ovoid in shape. Moreover, as noted above, in the exemplified embodiment the first and second bodies 210, 220 are truncated around the bottom so that the base 200 resembles a truncated ovoid. Nonetheless, it should be understood that the invention is not limited by the size and shape of the first and second bodies 210, 220 in all embodiments, and in certain other embodiments the first and second bodies 210, 220 may be of any size or shape that is suitable to be gripped by a human hand.

As discussed above, the utensil 100 may be considered a variation on or an improvement of traditional chopsticks. However, unlike traditional chopsticks that require the user to keep their lingers extended and substantially aligned with the rod portions of the chopsticks, the utensil 100 of the present invention is designed in such a manner that enables a user to hold the utensil 100 in a variety of different ways to optimize comfort and usability for any given user. Specifically, the utensil 100 may be operated with the user gripping only the base 200 portion of the utensil 100 or with the user gripping both the base 200 and a portion of the elongated rods 300, 400. Thus, a user may hold and use the utensil 100 using their hand and fingers together, just their fingers or just their fingertips. As described above, in certain embodiments the base 200 is shaped like a block. The block-like shape of the base 200 facilitates handling of the utensil 100 by the user within one hand with their fingers in a curled and relaxed position.

Further, as described above, the base 200 may be formed with a variety of different sizes such that the utensil 100 is also suitable for a wide variety of hand sizes. Moreover, in embodiments wherein the base 200 is ovoid in shape, the utensil 100 fits easily and comfortably within the hand of a user. When the first and second bodies 210, 220 of the base 200 are mirror-images of one another and symmetrical, the utensil 100 may be used easily by either hand. Finally, the planes defined by the curled fingers of the user when using the utensil 100 may be at any angle relative to the gripping tines (from oblique, to perpendicular, to parallel). This results in better utensil control, with less strain and fatigue for the user.

Referring now to FIGS. 1-3 and 12 concurrently, the operation of the utensil 100 of the present invention will be described. The first and second bodies 210, 220 of the base 200 are rotatably coupled together about an axis of rotation R-R. Therefore, the first and second bodies 210, 220 (along with the first and second elongated rods 300, 400) are configurable between an open position whereby the first and second elongated rods 300, 400 are separated or not in contact with one another (shown in FIGS. 1-3) and a closed position whereby the first and second elongated rods 300, 400 (specifically the first and second distal portions 302, 402) are in contact with one another (shown in FIG. 12). As best seen in FIG. 1, in the open position the first and second elongated rods 300, 400 are separated from one another by an angle $\theta_7$. In the exemplified embodiment, the angle $\theta_7$ is between 10-30°, and more preferably approximately 20°. Of course, the invention is not to be so limited and in certain other embodiments the angle $\theta_7$ can be greater or less than 30° or less than 10° as desired. Increasing the angle $\theta_7$ provides for greater separation between the first and second elongated rods 300, 400 so that greater amounts of food can be gripped between the first and second elongated rods 300, 400. However, increasing the angle $\theta_7$ may also be undesirable for a person with a smaller hand because it may make it more difficult to effectively grip the utensil 100. Thus, the angle $\theta_7$ can be altered and chosen as desirable for any given particular user.

Further, while in the exemplified embodiment the elongated rods 300, 400 extend about 20° apart from one another in the open position, the first and second bodies 210, 220 extend from one another a distance $D_B$. In certain exemplary embodiments, the distance $D_B$ is approximately ½ inch such that the first and second bodies 210, 220 need only be moved ½ inch between the open and closed positions. Of course, the distance $D_B$ can be greater or less than ½ inch in other embodiments, but it is preferable that the distance $D_B$ be less than one inch. Maintaining $D_B$ as a small distance in the open position of the utensil 100 facilitates the ease with which a user can grasp food between the elongated rods 300, 400 when $\theta_7$ is approximately 20° because only minimal pressure must be exerted to move the first and second bodies 210, 220 the small distance required to achieve the closed position. Thus, only a gentle squeeze is required to move the utensil 100 from the open position to the closed position.

As discussed above, the utensil 100 of the exemplified embodiment comprises first and second bottom surfaces 211, 221 that collectively define a support plane. In such embodiments, the axis of rotation R-R of the utensil 100 is substantially perpendicular with the support plane. Thus, in the exemplified embodiment the rotational axis R-R of the utensil 100 is substantially parallel with the Y-axis of the Cartesian coordinate system, while the support plane is substantially parallel with the X-Z plane of the Cartesian coordinate system. However, it should be noted that the invention is not so limited in all embodiments, and in certain alternate embodiments the axis of rotation R-R of the utensil 100 may be other than perpendicular to the support plane. For example, the axis of rotation R-R of the utensil 100 may be oriented at an oblique angle relative to the support plane, which will be discussed in more detail below with reference to FIGS. 13-20. Moreover, in still other embodiments, the utensil 100 may not be self-supporting and therefore may not comprise a support plane. Furthermore, in certain embodiments wherein the axis of rotation R-R is oriented at an oblique angle relative to the support plane, the axis of rotation R-R may still be extending along a Y-axis of the Cartesian coordinate system simply by shifting the Cartesian coordinate system.

Figure 4:
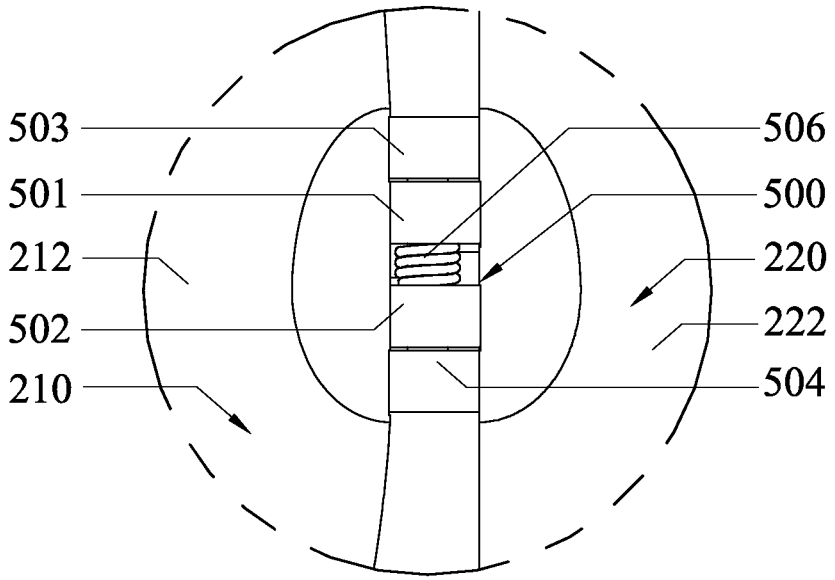
FIG. 4 is a close-up view of area IV of FIG. 3.

Referring to FIGS. 1, 3 and 4 concurrently, and as discussed in more detail below, a hinge 500 of the utensil 100 according to one embodiment of the present invention will be described. As discussed above, the first and second bodies 210, 220 are rotatably coupled together. According to the exemplified embodiment, the first and second bodies 210, 220 are rotatably coupled via the hinge 500. The hinge 500 is a multi-component device that is located between the first and second inner surfaces 213, 223 of the first and second bodies 210, 220. More specifically, the hinge 500 is partially coupled to each of the first and second inner surfaces 213, 223 of the first and second bodies 210, 220.

In the exemplified embodiment, the hinge 500 is located on the first and second bodies 210, 220 at a location opposite from the location at which the first and second elongated rods 300, 400 extend from the first and second bodies 210, 220. Thus, the hinge 500 is located at the proximal-most end 151 of the utensil 100. However, it should be understood that in alternate embodiments the hinge 500 may be located at any other location along the base 200 of the utensil 100. For example, the hinge 500 may protrude out from the back of the base 200 or be located closer to the top or bottom of the base 200. Father, the invention is not limited to the specific hinge 500 described herein (a barrel hinge), but rather alternate types of hinges, such as, for example without limitation, living hinges, pivot hinges, butt/Mortise hinges, case hinges, continuous hinges, concealed hinges, butterfly hinges, flag hinges, strap hinges, H hinges and the like may be used within the utensil 100 of the present invention. Moreover, in certain other embodiments, the hinge 500 may be omitted altogether and the utensil 100 may comprise any other means by which the first and second bodies 210, 220 may be rotatably coupled together. The hinge 500 will be described in more detail below with reference to FIGS. 4 and 9 concurrently.

Referring again to FIGS. 1-3, the first and second elongated rods 300, 400 according to an embodiment of the present invention are illustrated. The first elongated rod 300 extends from the first body 210 and the second elongated rod 400 extends from the second body 220. In the exemplified embodiment, the first and second elongated rods 300, 400 do not extend upwardly from the upper-most portion 153 of the first and second bodies 210, 220, respectively. Rather, the first and second elongated rods 300, 400 are coupled to and extend from the outer surfaces 212, 222 of the first and second bodies 210, 220, respectively, at a location that is below the upper-most portion 153 of the first and second bodies 210, 220. Specifically, in the exemplified embodiment the first and second elongated rods 300, 400 extend from the first and second bodies 210, 220 at a location that is between ⅔ of the height $H_B$ of the body 200 and the upper-most portion 153 of the body 200. Of course, the invention is not to be so limited in all embodiments and in certain other embodiments the first and second elongated rods 300, 400 may extend from the upper-most portion 153 of first and second bodies 210, 220.

The first elongated rod 300 comprises a first base portion 301, a first distal portion 302, a first inner surface 303 and a first outer surface 304. Similarly, the second elongated rod 400 comprises a second base portion 401, a second distal portion 402, a second inner surface 403 and a second outer surface 404. The first and second elongated rods 300, 400 are designed such that when they are brought together (into the closed position), they securely grasp or clamp morsels of food or other objects there between. More specifically, when the utensil 100 is in the closed position (FIG. 12), the first distal portion 302 of the first elongated rod 300 comes into contact with at least a portion of the second distal portion 402 of the second elongated rod 400 such that morsels of food can be caught between and grasped by the first and second distal portions 302, 402 of the first and second elongated rods 300, 400.

Similar to the first and second bodies 210, 220, the first and second elongated rods 300, 400 are substantial mirror images of each other. However, the invention is not so limited in all embodiments and in certain alternate embodiments the first and second elongated rods 300, 400 may be differently shaped for various reasons, such as to be more efficiently used by people who are left-handed or right-handed. Further, in the exemplified embodiment, the first and second elongated rods 300, 400 are made of the same material as the base 200, such as, for example without limitation, a dishwasher-safe, FDA-approved thermoplastic (e.g. Acrylonitrile Butadiene Styrene (ABS)), Nylon, or glass fill. However, it should be understood that the invention is not so limited in all embodiments and in certain other embodiments the first and second elongated rods 300, 400 may be made of a different material from the base 200.

In the exemplified embodiment, the first and second elongated rods 300, 400 are rigidly connected to the first and second bodies 210, 220, respectively. Specifically, the first and second base portions 301, 401 are rigidly connected to the first and second outer surfaces 212, 222 of the first and second bodies 210, 220. However, it should be noted that in alternate embodiments, the first and second elongated rods 300, 400 may be flexibly connected to the first and second bodies 210, 220, respectively such that the first and second elongated rods 300, 400 can flex and/or move relative to the first and second bodies 210, 220.

In certain embodiments, the first and second base portions 301, 401 of the first and second elongated rods 300, 400 are integrally formed with the first and second bodies 210, 220. However, the invention is not to be so limited in all embodiments and in other embodiments the first and second elongated rods 300, 400 and the first and second bodies 210, 220 may be formed as separate components which are operably connected at a later stage of the manufacturing process by any suitable technique known in the art, including without limitation thermal or ultrasonic welding, a tight-fit assembly, a coupling sleeve, threaded engagement, adhesion, fasteners or the like. Whether the first and second elongated rods 300, 400 and the first and second bodies 210, 220 are of a unitary or multi-piece construction (including connection techniques) is not limiting of the present invention, unless specifically claimed. In some embodiments of the invention, the first and second elongated rods 300, 400 may be detachable (and replaceable) from the first and second bodies 210, 220 using techniques known in the art so that the first and second elongated rods 300, 400 can be cleaned or replaced as desired.

Figure 5:
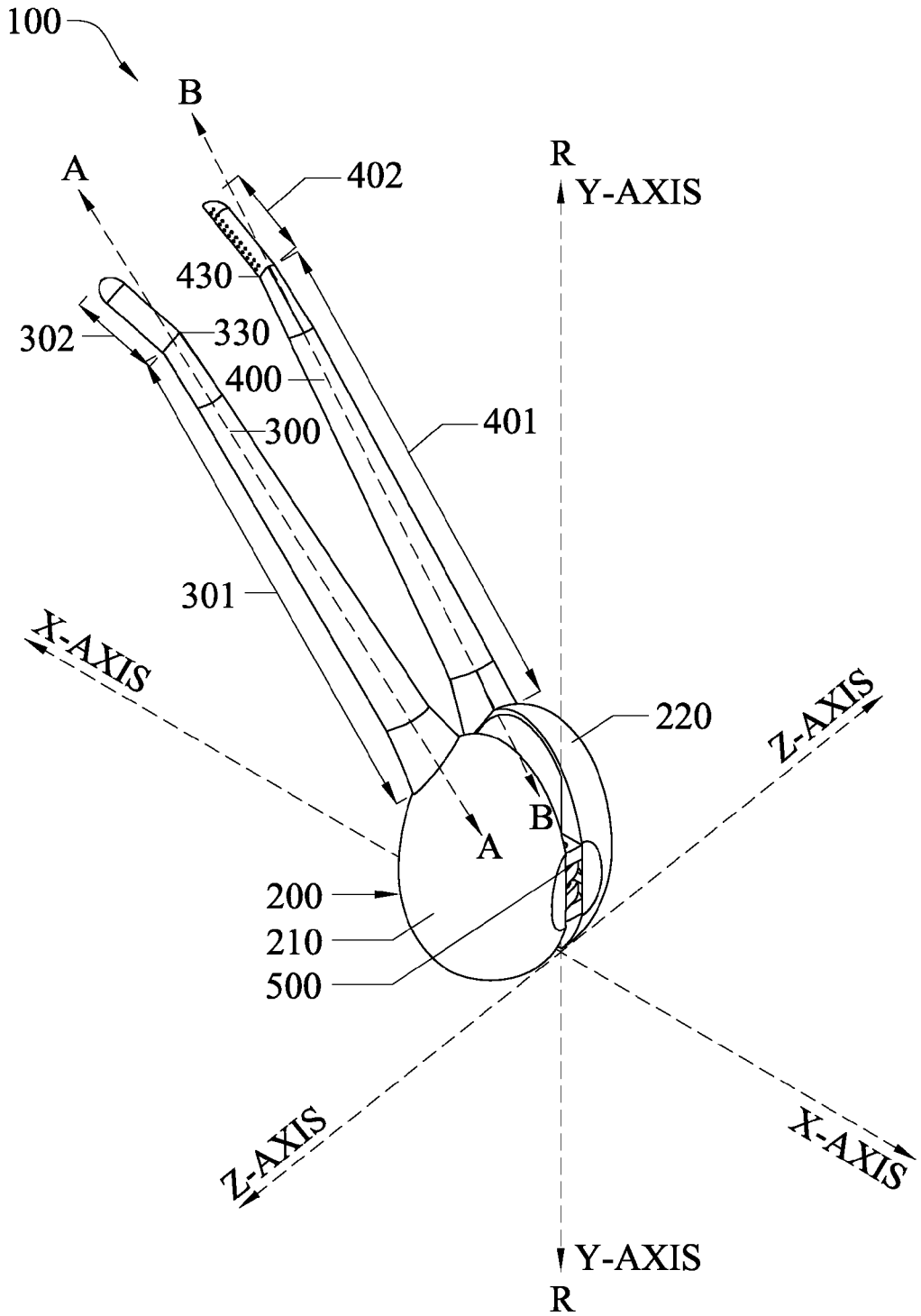
FIG. 5 is a perspective view of the utensil of FIG. 1 positioned along the three-dimensional Cartesian coordinate system.
Figure 6:
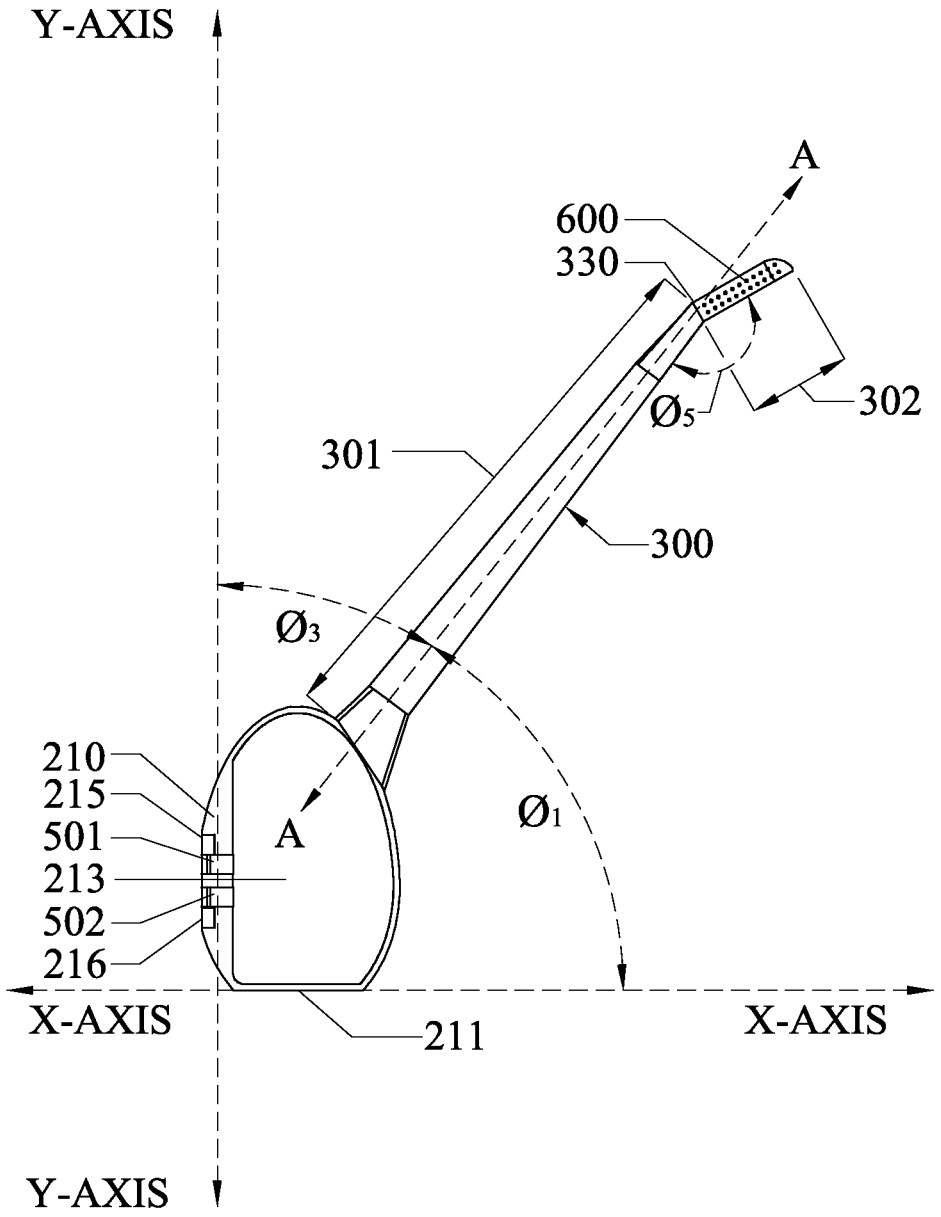
FIG. 6 is a side view of a first body and a first elongated rod of the utensil of FIG. 1 positioned along the X-Y plane of the three-dimensional Cartesian coordinate system.
Figure 7:
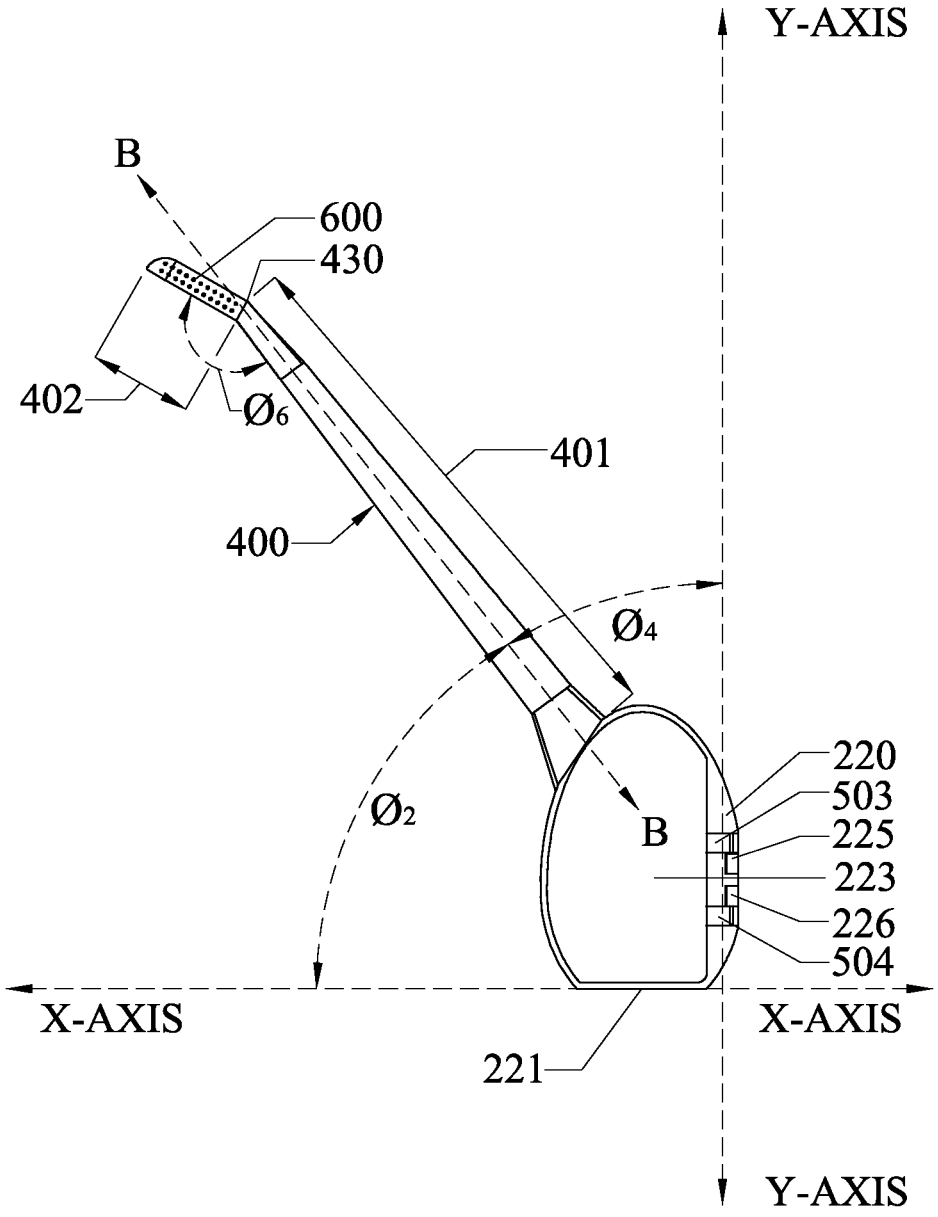
FIG. 7 is a side view of a second body and a second elongated rod of the utensil of FIG. 1 positioned along the X-Y plane of the three-dimensional Cartesian coordinate system.

Referring to FIGS. 5-7 concurrently, the utensil 100 is illustrated positioned along the three-dimensional X-Y-Z Cartesian coordinate system. As illustrated, the first base portion 301 of the first elongated rod 300 extends from the first body 210 along a first rod axis A-A. Similarly, the second base portion 301 of the second elongated rod 400 extends from the second body 220 along a second rod axis B-B. When the utensil 100 is in the open position, the first rod axis A-A and the second rod axis B-B diverge from one another with distance from the base 200 (see FIG. 1). In certain embodiments, the first and second elongated rods 300, 400 are formed from a single planar section of material. However, the invention is not to be so limited and in certain other embodiments the first and second elongated rods 300, 400 can be formed from more than one planar section of material whereby each subsequent section of material is connected obliquely to the previous section.

In the exemplified embodiment, the first and second distal portions 302, 402 are obliquely connected to distal most ends 330, 430 of the base portions 301, 401. Therefore, the first and second elongated rods 300, 400 comprise a plurality of planar sections that are obliquely connected to one another (i.e., a first planar section formed from the base portions 301, 401 and a second planar section formed from the distal portions 302, 402). Thus, the first and second elongated rods 300, 400 comprise the first and second base portions 301, 401, which each comprise one or more planar sections obliquely connected to one another, and the first and second distal portions 302, 402, which are obliquely connected to the distal most ends 330, 430 of the first and second proximal portions 301, 401.

As discussed in more detail below, the distal portions 302, 402 are obliquely connected to the base portions 301, 401 in a manner such that that the distal portions 302, 402 are angled downwardly relative to the first and second rod axes A-A, B-B in a direction towards the base 200. Thus, each of the distal portions 302, 402 has an axis that that forms an angle with the support plane of the utensil 100 that is less than an angle formed between the first and second rod axes A-A, B-B and the support plane of the utensil 100. The angle at which the distal portions 302, 402 extend from the base portions 301, 302 (discussed in detail below) allows for the distal portions 302, 402 to be oriented at a small, acute angle relative to a plate or other planar surface, which in turn enables food or other objects to be more easily grasped by the utensil 100.

However, it should be understood that in alternate embodiments, the base portions 301, 401 and the distal portions 302, 402 may be formed from a single elongated planar section that extends from the first and second bodies 210, 220, respectively. Thus, in one embodiment, the first and second distal portions 302, 402 extend from the first and second base portions 301, 401 in a parallel manner relative to one another so that the entirety of the first and second elongated rods 300, 400 (including both the base portions 301, 401 and the distal portions 401, 402) extend from the first and second bodies 210, 220 in a substantially planar manner and along the first and second rod axes A-A, B-B, respectively. Further, the invention is not limited to planar sections, and in alternate embodiments, the sections may be non-planar or curved sections. Moreover, in one embodiment, the first and second elongated rods 300, 400 may comprise both planar and curved sections.

In certain embodiments, the first and second base portions 301, 401 extend about 5 cm to 20.3 cm, and more particularly approximately 12.7 cm, from the first and second bodies 210, 220 to the distal most ends 330, 430 of the first and second base portions 301, 401, respectively. Furthermore, the first and second distal portions 302, 402 extend about 1.2 cm to 7.7 cm, and more particularly approximately 2.5 cm, from the distal most ends 330, 430 of the first and second base portions 301, 401, respectively. Selecting desirable lengths for the first and second base portions 301, 401 and the first and second distal portions 302, 402 as well as desirable angled transitions between the first and second base portions 301, 401 and the first and second distal portions 302, 402 of the elongated rods 300, 400 facilitate ease of use of the utensil 100. However, it should be noted that the lengths of the first and second base portions 301, 401 and the lengths of the first and second distal portions 302, 402 are not to be so limited in all embodiments, and may be any length depending on particular design choices.

Referring again to FIGS. 1-3 concurrently, the first and second inner surfaces 303, 403 are rounded on the first and second base portions 301, 401 and then transition to being planar on the first and second distal portions 302, 402. Further, the inner surfaces 303, 403 of the first and second distal portions 302, 402 are also preferably substantially coplanar such that they may easily clamp or grasp food or other objects there between. In alternate embodiments, the first and second inner surfaces 303, 403 are substantially constant (rounded, planar or otherwise) along the entirety of the length of the first and second elongated rods 300, 400. However, the invention is not so limited in all embodiments and the contour of the first and second inner surfaces 303, 403 may alter in any fashion along the length of the first and second elongated rods 300, 400. Further, in other alternate embodiments, the first inner surface 303 may be contoured differently from the second inner surface 403.

In the exemplified embodiment, the first and second outer surfaces 304, 404 are rounded along the entire length of the first and second base portions 301, 401. Moreover, the shape and contour of the first and second outer surfaces 304, 404 transitions so that the outer surfaces 304, 404 of the first and second distal portions 302, 402 are rounded but flat on the bottom. Thus, the outer surfaces 304, 404 of the first and second distal portions 302, 402 of the first and second elongated rods 301, 401 are rounded with a truncated bottom surface. The cross-sectional shape of the first and second base portions 301, 401 is substantially oval in shape. Further, the cross-section of the first and second distal portions 302, 402 is substantially semicircle in shape. Therefore, the first and second elongated rods 300, 400 transition from having a cross-sectional shape that is oval to having a cross-sectional shape that is a half-circle with rounded edges. The shape of the first and Second elongated rods 300, 400 provides for strength in the vertical plane for lifting food or other objects, while also providing some resilience in the horizontal plane to easier enable the clamping or grasping of food or other objects. Further, the first and second distal portions 302, 402 are configured to be placed in a person's mouth. Thus, the distal most tips of the first and second distal portions 302, 402 (i.e., the distal-most end 152 of the utensil 100) are rounded to prevent the utensil 100 from scraping, cutting or otherwise damaging a user's mouth. However, in alternate embodiments, the first and second outer surfaces 304, 404 may be planar, flat or have any other contour. Similarly, in alternate embodiments, the first and second outer surfaces 304, 404 may be substantially constant along the entirety of the length of the first and second elongated rods 300, 400.

As noted above, the cross-sectional shape of the first and second distal portions 302, 402 is substantially semicircle in shape, which provides for two planar surfaces to clamp food or other objects. Therefore, food may be grasped between the inner surfaces 303, 403 of the distal portions 302, 402 of the elongated rods 300, 400. Further, in certain embodiments, the inner surfaces 303, 403 of the distal portions 302, 402 are slightly concave to enable smaller foods to be scooped up. Finally, the outer surfaces 304, 404 of the distal portions 302, 402 are rounded to facilitate a comfortable withdrawal from a user's mouth. It should be noted that the invention is not so limited, and in alternate embodiments the inner surfaces 303, 403 and the outer surfaces 304, 404 of the first and second distal portions 302, 402 may be configured, shaped or textured in any manner.

Referring again to FIGS. 5-7 and as discussed above, the first base portion 301 of the first elongated rod 300 extends from the first body 210 along the first rod axis A-A. The first base portion 301 extends from the first body 210 and transitions into the first distal portion 302. The first distal portion 302 is connected to the first base portion 301 at an oblique angle $\theta_5$. Further, since the axis of rotation R-R of the utensil 100 is along the Y-axis of the Cartesian coordinate plane, the first rod axis A-A extends from the first body 210 at an angle $\theta_3$ that is oblique to the axis of rotation R-R and at an angle $\theta_1$ that is oblique to the support plane.

Similarly, the second base portion 301 of the second elongated rod 400 extends from the second body 220 along a second rod axis B-B. The second proximal portion 401 extends from the second body 220 and transitions into the second distal portion 402. The second distal portion 402 is connected to the second base portion 301 at an oblique angle $\theta_6$. Further, since the axis of rotation R-R of the utensil 100 is along the Y-axis of the Cartesian coordinate plane, the second rod axis B-B extends from the second body 220 at an angle $\theta_4$ that is oblique to the axis of rotation R-R and at an angle $\theta_2$ that is oblique to the support plane of the utensil 100.

When the utensil 100 is supported on its support plane (defined collectively as the first and second bottom surfaces 211, 221) and the support plane rests on the X-Z Cartesian coordinate plane, the first and second rod axes A-A, B-B are oblique to both the X-Z Cartesian coordinate plane and the axis of rotation R-R (which in the exemplified embodiments of FIGS. 5-7 is the Y-axis). Further, the first and second rod axes A-A, B-B are also oblique to the X-Y and Y-Z Cartesian coordinate planes. Moreover, the first rod axis A-A forms the angle $\theta_1$ with respect to the X-Z plane and forms an angle $\theta_3$ with respect to the Y-axis. Similarly, the second rod axis B-B forms the angle $\theta_2$ with respect to the X-Z plane and forms an angle $\theta_4$ with respect to the Y-axis. In the exemplified embodiment, the axis A-A is substantially coplanar with the axis B-B, and thus angle $\theta_1$ is substantially equal to angle $\theta_2$ and angle $\theta_3$ is substantially equal to angle $\theta_4$. Further, in the exemplified embodiment, the angles at which the first and second distal portions 302, 402 are connected to the first and second proximal portions 301, 401 are substantially equal, and thus the angle $\theta_5$ is substantially equal to the angle $\theta_6$. However, the invention is not to be so limited in all embodiments and in alternate embodiments the axis A-A may be non-coplanar with the axis B-B and the angles that are noted above as being substantially equal may be different from one another.

In certain embodiments, the angles $\theta_3$ and $\theta_4$ are between 5°-55°, more specifically between 20°-40°, and even more specifically approximately 30°. Moreover, the angles $\theta_1$ and $\theta_2$ are between 35° and 85°, more specifically between 50° and 70°, and even more specifically approximately 60°. Further, in certain embodiments, the angles $\theta_5$ and $\theta_6$ are between 5°-25°, more specifically between 10°-20°, and even more specifically approximately 15°. Therefore, in the exemplified embodiment, the first and second elongated rods 300, 400 extend from the first and second bodies 210, 220 along the axes A-A, B-B, which are Oriented at an approximately 30° angle relative to the axis of rotation R-R of the utensil 100 and at an approximately 60° angle relative to the support surface.

Furthermore, the first and second distal portions 302, 402 are connected to the distal most ends 330, 430 of the first and second proximal portions 301, 401 and are oriented at an approximately 15° angle relative to the axes A-A, B-B in a direction away from the axis of rotation R-R. Thus, the first and second distal portions 302, 402 are oriented at a smaller angle relative to the support surface than the rod axes A-A, B-B. However, it should be understood that the invention is not to be so limited in all embodiments and in certain alternate embodiments the first and second elongated rods 300, 400 (including the first and second proximal portions 301, 401 and the first and second distal portions 302, 402) may be configured along other angles with respect to the axis of rotation R-R and the support surface.

Figure 8:
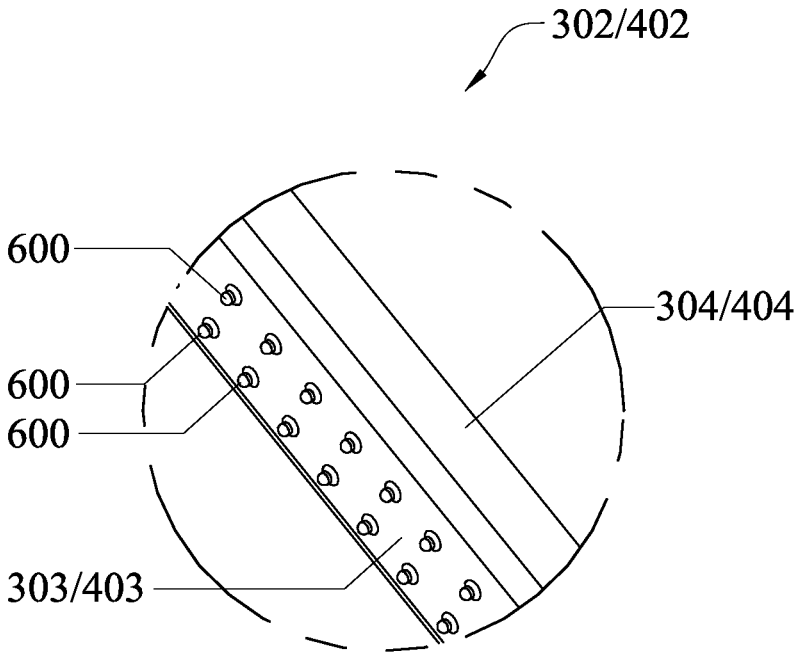
FIG. 8 is a close-up view of area VIII of FIG. 1.

Referring to FIGS. 1, 6 and 8, the utensil 100 will be further described. In the exemplified embodiment, each of the first and second distal portions 302, 402 comprises nubs 600. The nubs 600 protrude from the first and second inner surfaces 303, 403 of the first and second distal portions 302, 402 and are configured to aid in the grasping and holding of food or other objects. The nubs 600 are preferably made of a resilient plastic material that is a dishwasher-safe, FDA-approved thermoplastic such as Acrylonitrile Butadiene Styrene (ABS); however, in alternate embodiments the nubs 600 may be constructed of any other suitable material. For example, the nubs 600 may be formed of a suitable thermoplastic or elastomeric material.

In the exemplified embodiment, the nubs 600 are arranged in two parallel rows along the length of the first and second distal portions 302, 402 of the first and second elongated rods 300, 400. More specifically, the nubs 600 are arranged in two rows, each of which comprises eleven of the nubs 600. Of course, the invention is not to be so limited in all embodiments and in certain other embodiments more or less than eleven nubs can be included in each of the rows. Furthermore, in the embodiment exemplified in FIG. 8, the nubs 600 in the adjacent rows are aligned with one another. However, the invention is not to be so limited and in certain other embodiments (see FIG. 19), the nubs in adjacent rows may be staggered or offset. Moreover, in other embodiments the nubs 600 may merely comprise a single row, or may comprise more than two rows.

Referring to FIG. 8, a close-up view of the first and second inner surfaces 303, 403 comprising nubs 600 according to one embodiment of the present invention is illustrated. In the exemplified embodiments, the nubs 600 are conically shaped. The invention however is not so limited in all embodiments and in alternate embodiments the nubs 600 may be shaped like a cylinder, pyramid, rectangle, hexagonal prism, or any other shape suitable for grasping food or other objects.

The nubs 600 are designed so to be raised from the inner surfaces 303, 403 of the distal portions 302, 402 of the first and second elongated rods 300, 400 to improve the retention capabilities of the utensil 100 while minimizing the amount of food or other debris that may become trapped and left behind on the surface of the elongated rods 300, 400. Further, since food does not get caught as easily, the utensil 100 is easier to clean and keep sanitary. In the exemplified embodiment, the nubs 600 face inward to reduce their chances of rubbing against the user's tongue or lips. However, it should be noted that the invention is not so limited in all embodiments, and in certain alternate embodiments the nubs 600 may be altogether omitted.

Referring to FIGS. 4-6 and 9, the hinge 500 of the utensil 100 will be further described. In the exemplified embodiment, the hinge 500 comprises first and second bosses 501, 502 that extend outwardly from the inner surface 213 of the first body 210, third and fourth bosses 503, 504 that extend outwardly from the inner surface 214 of the second body 220, and a hinge pin 505. Further, the utensil 100 also comprises a resilient member 506. Although exemplified as a torsion spring, the resilient member 506 is not to be so limited in all embodiments, and in alternate embodiments the resilient member 506 may be any other means for biasing the utensil 100 in either the open or closed position.

The first and second bosses 501, 502 are preferably cylindrical and are located on the first body 210 along the first inner surface 213. Similarly, the third and fourth bosses 503, 504 are also preferably cylindrical and located on the second body 220 along the second inner surface 223. The bosses 501-504 comprise a hollow cavity in their center that is configured to receive the hinge pin 505, as discussed in more detail below. The first inner surface 213 further comprises a first recess and a second recess 215, 216 that correspond in position, shape and size to the third and fourth bosses 503, 504 and the second inner surface 223 further comprises a third recess and a fourth recess 225, 226 that correspond in position, shape and size to the first and second bosses 501, 502. Therefore, when the first and second bodies 210, 220 are coupled together, a portion of the first and second bosses 501, 502 are received by and rest within the third and fourth recesses 225, 226 of the second inner surface 223, and a portion of the third and fourth bosses 503, 504 are received by and rest within the two recesses 215, 216 of the first inner surface 213.

According to the exemplified embodiment, the first and second bodies 210, 220 may be securely coupled together using the hinge 500 and the resilient member 506. Thus, to couple the first and second bodies 210, 220 to one another, the bosses 501-504 of the first and second bodies 210, 220 are aligned and the resilient member 506 is placed in between the first and second bosses 501, 502. Next, the hinge pin 505 is inserted through the cavities in the bosses 501-504 and the resilient member 506 so that the first and second bodies 210, 220 are rotatably coupled together about the rotation axis R-R. Thereafter, the first and second bodies 210, 220 (along with the first and second elongated rods 300, 400) are rotatable about the hinge pin 505.

In certain exemplary embodiments, the hinge pin 505 is made of stainless steel. However, the invention is not so limited in all embodiments and in certain other embodiments the hinge pin 505 may be made of any other suitable material, such as a metal other than stainless steel, a thermoplastic material or the like. The hinge pin 505 is configured to be inserted into the cavities of the bosses 501-504 so that the hinge pin 505 securely couples the bosses 501-504 (and thus the first and second bodies 210, 220 of the base 200) together. In certain embodiments, the hinge pin 505 has a knurl on the upper end. The knurl is configured so that when the hinge pin 505 is inserted into the cavities of the bosses 501-504, the knurl is secured into the boss 503 and allows the other bosses 501, 502, 504 to freely rotate.

In the exemplified embodiment, the resilient member 506 is made of stainless steel. However, the invention is not so limited and in alternate embodiments the resilient member 506 may be made of any other suitable material. Once coupled together, the resilient member 506 is configured such that the utensil 100 is biased in the open position (with the first and second elongated rods 300, 400 spaced apart from one another). In the exemplified embodiment, the resilient member 506 comprises elongated arms 509 that push against the respective inner surfaces 213, 223 of the base 200 with mild pressure to spread the elongated rods 300, 400 apart and in the open position. Therefore, when the user squeezes the first and second bodies 210, 220 of the base 200 together, the first and second elongated rods 300, 400 are moved into contact, thereby securing any food or other object there between. When the user places the food in their mouths while keeping the utensil 100 in the closed position, the user only has to release the pressure keeping the first and second bodies 210, 220 together, and the resilient member 506 will force the first and second elongated rods 300, 400 apart thereby freeing the food into the user's mouth. It should be noted that the invention is not so limited in all embodiments, and in alternate embodiments the resilient member 506 may be omitted.

In the exemplified embodiment, close tolerances are maintained between the moving surfaces of the hinge 500 (approximately 0.25 mm throughout the restricted range of motion). The close tolerances are smaller than the thickness of a fold of human skin (typically around 1 mm-8 mm). Therefore, the skin of the average person will not get caught between the moving surfaces of the hinge 500, which allows the hinge 500 to be a "pinch-proof" hinge.

Figure 9:
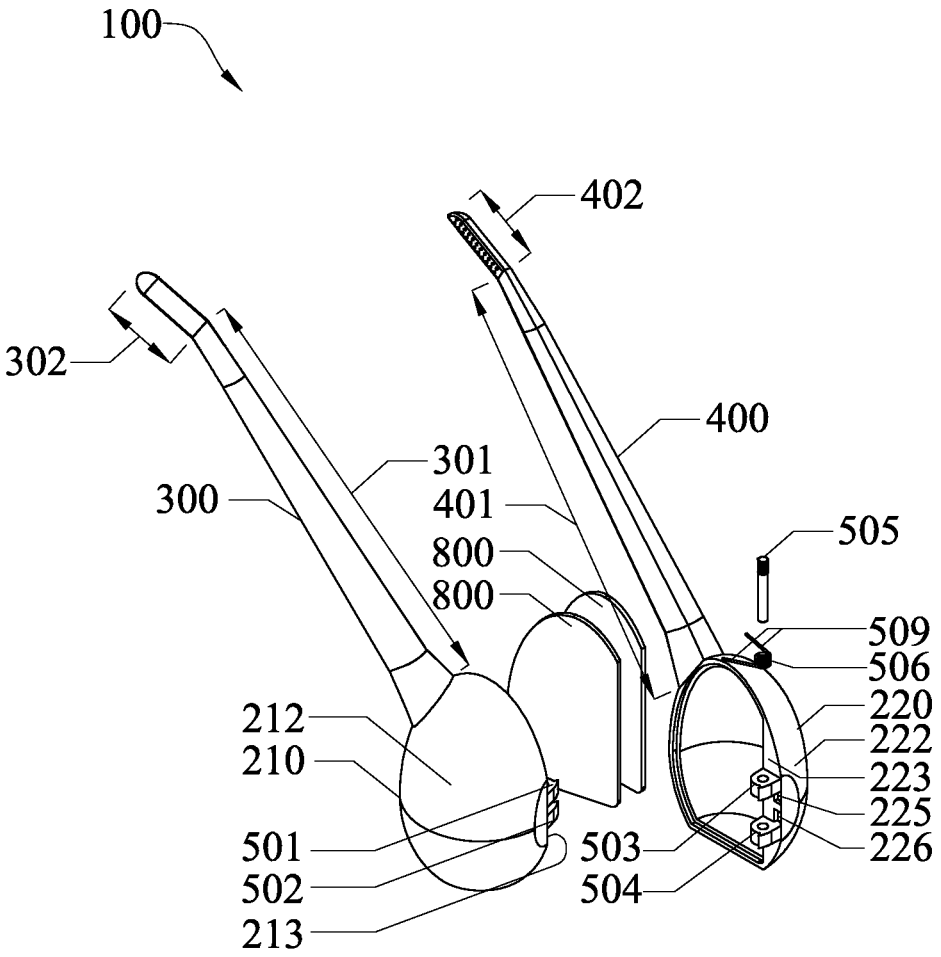
FIG. 9 is an exploded isometric view of the utensil of FIG. 1.

Referring solely to FIG. 9, according to one embodiment of the present invention, the first and second bodies 210, 220 of the utensil 100 are hollow. In embodiments where the first and second bodies 210, 220 are hollow, the utensil 100 further comprises removable plates 800. In such art embodiment, the plates 800 form the first and second inner surfaces 213, 223 of the first and second bodies 210, 220. In one embodiment, the plates 800 may be secured to the first and second inner surfaces 213, 223 by means of ultrasonic glue or welding. However, it should be noted that the invention is not so limited and the plates 800 may be omitted in certain other embodiments, and thus the first and second bodies 210, 220 may be hollow regardless of whether the first and second inner surfaces 213, 223 comprise plates 800. Further, in alternate embodiments of the present invention the first and second bodies 210, 220 may be formed as solid bodies.

Further, it should be noted that in embodiments where the first and second bodies 210, 220 are hollow, the first and second bodies 210, 220 may be used to hold or dispense substances that may be used to supplement the use of the utensil 100. For example, in one embodiment, the first and second bodies 210, 220 may comprise salt and pepper, respectively. In alternate embodiments, the first and second bodies 210, 220 may comprise sauces and condiments, such as, but not limited to soy, ginger, wasabi, ketchup, mustard or hot sauce. Moreover, in other alternate embodiments, the first and second bodies 210, 220 may be configured to hold napkins or other articles used during dining.

Figure 10:
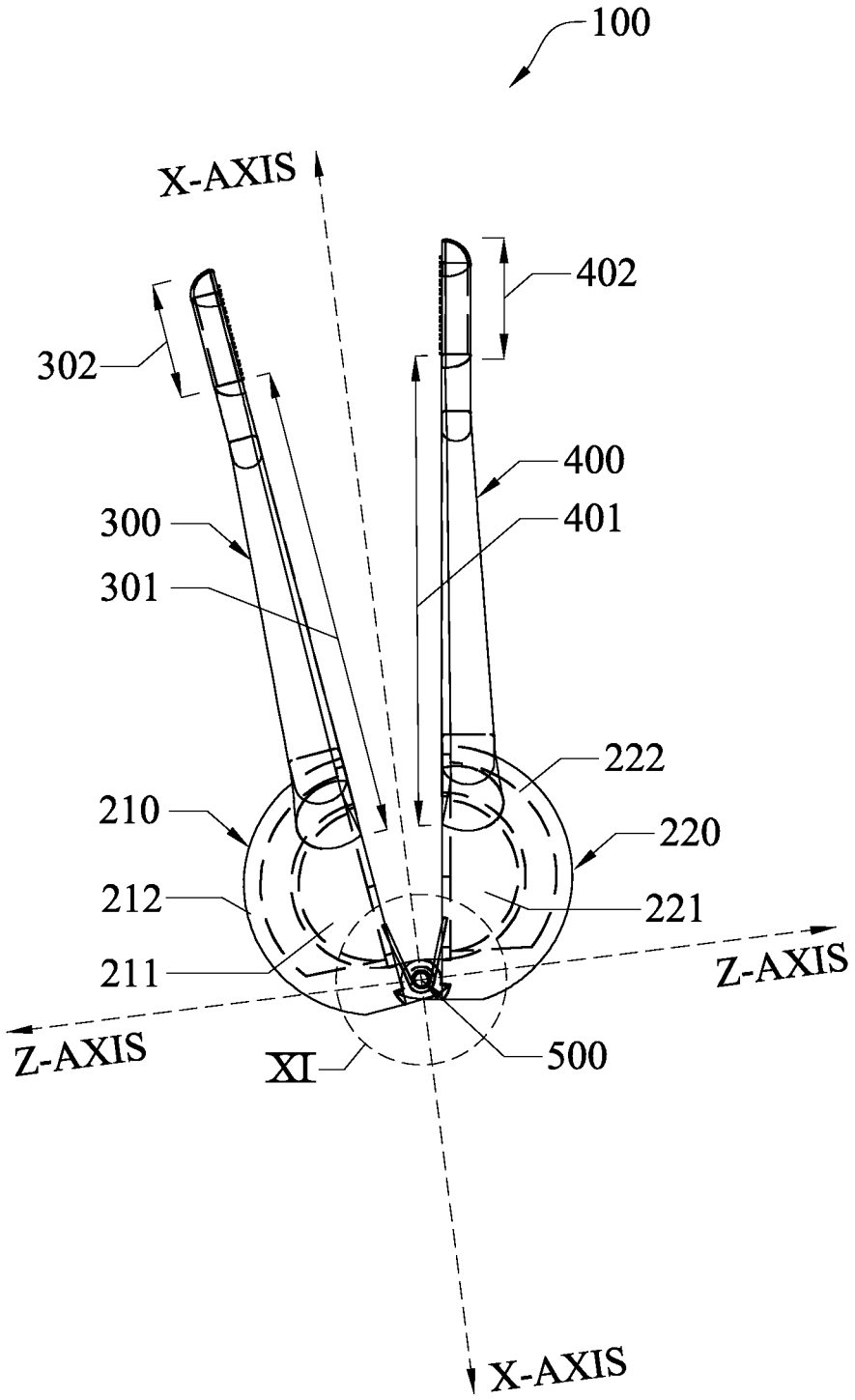
FIG. 10 is a front view of the utensil of FIG. 1 positioned along the X-Z plane of the three-dimensional Cartesian coordinate system.
Figure 11:
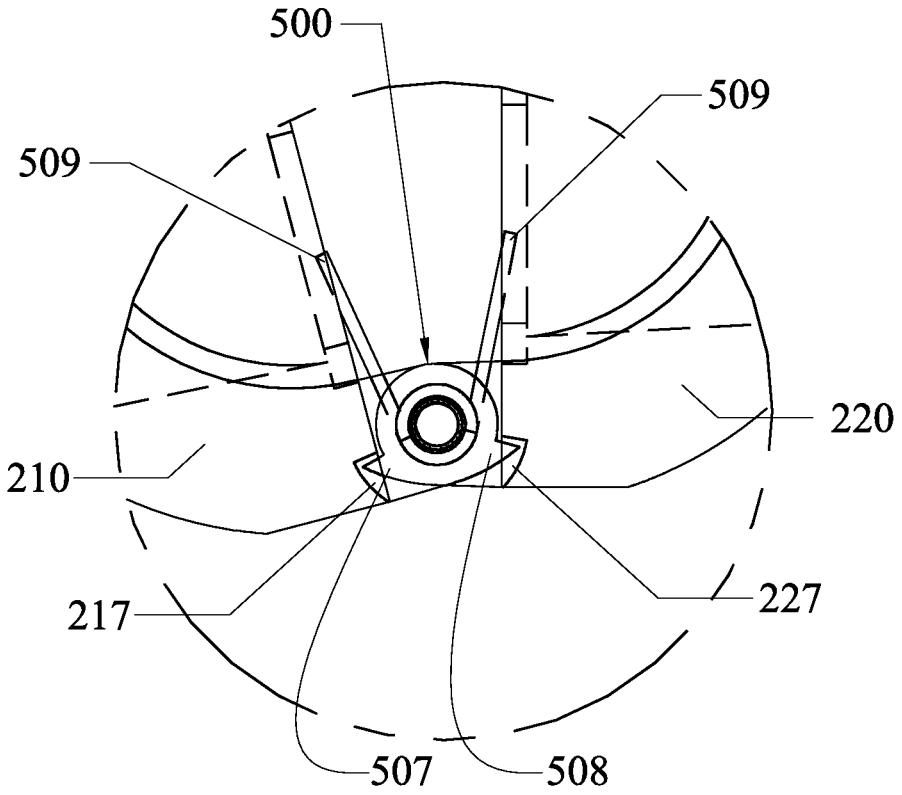
FIG. 11 is a close-up view of area XI of FIG. 10.

Referring to FIGS. 10 and 11 concurrently, the hinge 500 of an embodiment of the present invention is discussed in more detail. According to an embodiment of the present invention, the second and fourth bosses 502, 504 comprise raised dogs 507, 508 and the second and fourth recesses 216, 226 comprise first and second shelves 217, 227. When moving the utensil 100 from the closed position to the open position, the raised dogs 507, 508 of the second and fourth bosses 502, 504 are configured to come into contact with the first and second shelves 217, 227, respectively, to restrict the range of motion of the hinge 500 so that the first and second elongated rods 300, 400 can not be spaced from one another greater than the angle $\theta_1$. Specifically, in the exemplified embodiment of the present invention, the locations of the raised dogs 507, 508 and the shelves 217, 227 allows for the first and second distal portions 301, 401 of the elongated rods 300, 400 to extend to approximately 20° apart from one another in the open position. Without the raised dogs 507, 508 and the shelves 217, 227, the hinge 500 would not be so restrained. It should be understood that the invention is not limited to a 20° range of motion, and in alternate embodiments the hinge 500 may enable the first and second elongated rods 300, 400 to rotate at a greater or lesser degree. Moreover, the invention is not to be limited to the specific hinge 500 described and illustrated herein in all embodiments.

Figure 12:
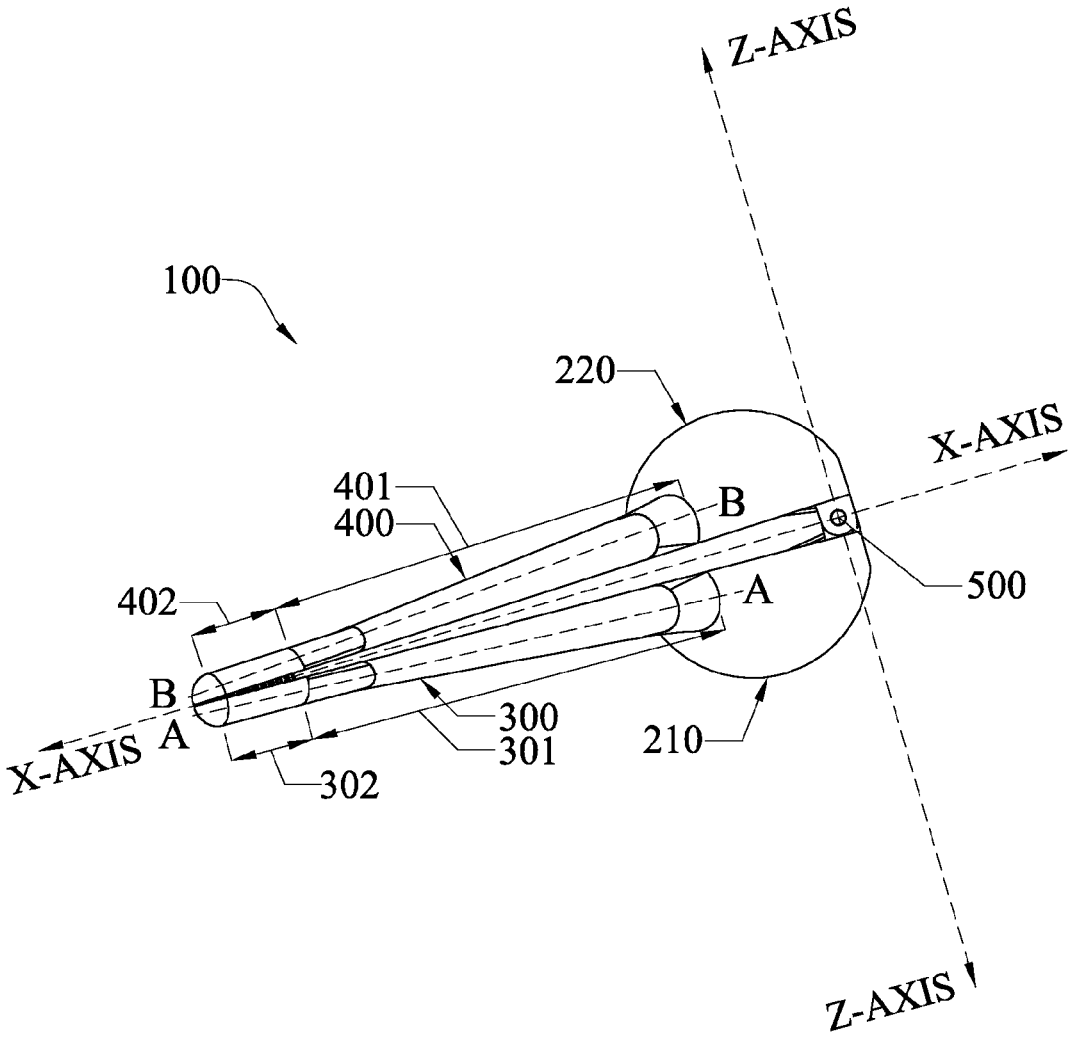
FIG. 12 is a top view of the utensil of FIG. 1 in a closed position along the X-Z plane of the three-dimensional Cartesian coordinate system.

Referring to FIG. 12, a top view of the utensil 100 in the closed position is illustrated along the X-Z plane of the Cartesian coordinate system. As illustrated, when the utensil 100 is in the closed position, the distal portions 302, 402 of the elongated rods 300, 400 are in direct contact with one another so that food or other objects may be grasped or clamped there between. Thus, when the utensil 100 is in the closed position, the first and second rod axes A-A, B-B converge toward one another, thereby enabling the distal portions 302, 402 of the elongated rods 300, 400 to come into contact with one another. Further, it should be noted that due to the angle at which the elongated rods 300, 400 extend from the base 200, the first and second bodies 210, 220 do not come into direct contact with one another even when the utensil 100 is in the closed position. In the exemplified embodiment, the first and second base portions 301, 401 of the first and second elongated rods 300, 400 are also spaced from one another even when the utensil 100 is in the closed position. Of course, the invention is not to be so limited in all embodiments and in certain other embodiments the first and second base portions 301, 401 of the first and second elongated rods 300, 400 and/or the first and second bodies 210, 220 may come into contact with one another when the utensil 100 is in the closed position to further enhance the ability of the utensil 100 to grasp food particles.

Moreover, when comparing the utensil 100 in the open position as illustrated in FIG. 1 with the utensil 100 in the closed position as illustrated in FIG. 12, the elongated rods 300, 400 move a greater distance than do the first and second bodies 210, 220. Thus, although the elongated rods 300, 400 are extended approximately 20° apart from one another in the exemplified embodiment when in the open position, the first and second bodies 210, 220 only have to move about 1.3 cm (i.e., ½ inch) in order to bring the elongated rods 300, 400 into contact with one another in the closed position. Therefore, it is easy for a user to grasp food between the elongated rods 300, 400 because only minimal pressure must be exerted to move the first and second bodies 210, 220 the small distance required. This allows the utensil 100 to be more easily used. It should be noted that the present invention is not limited to the specific the dimensions and angles provided herein in all embodiments.

Referring now to FIGS. 13-20, an alternative embodiment of the present invention will be described. FIGS. 13-20 are numbered in a similar manner to that discussed above, except that the suffix A will be used to describe each feature. In the interest of brevity, not all reference numerals will be rewritten in FIGS. 13-20. However, it should be understood that features in FIGS. 13-20 that are not numbered are the same as similar features from FIGS. 1-12 described above. Furthermore, not all features of FIGS. 13-20 will be described below, with it being understood that the description above with regard to FIGS. 1-12 will apply. Specifically, certain reference numerals will be provided in FIGS. 13-20 without a detailed description of that reference numeral in the specification. However, the description provided for the similar reference numeral (without the suffix A) in the embodiment above applies to those reference numerals that are not described in detail below.

Figure 13:
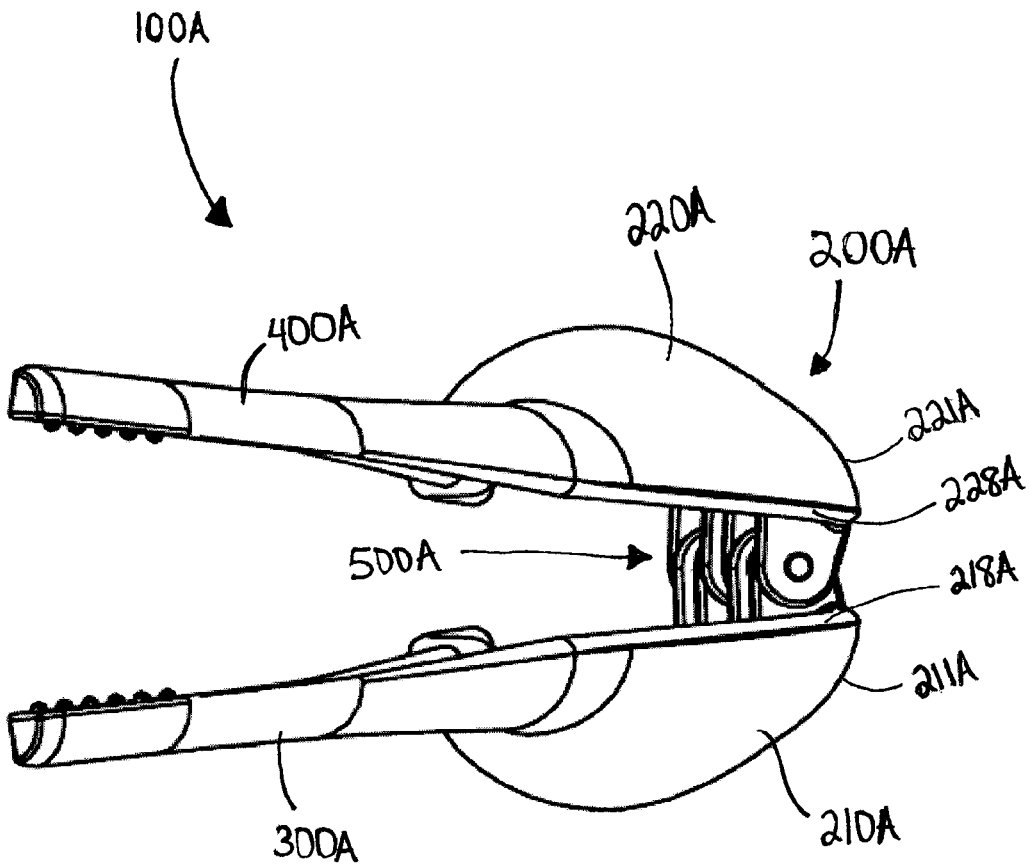
FIG. 13 is a top view of a utensil in an open position according to a second embodiment of the present invention.
Figure 14:
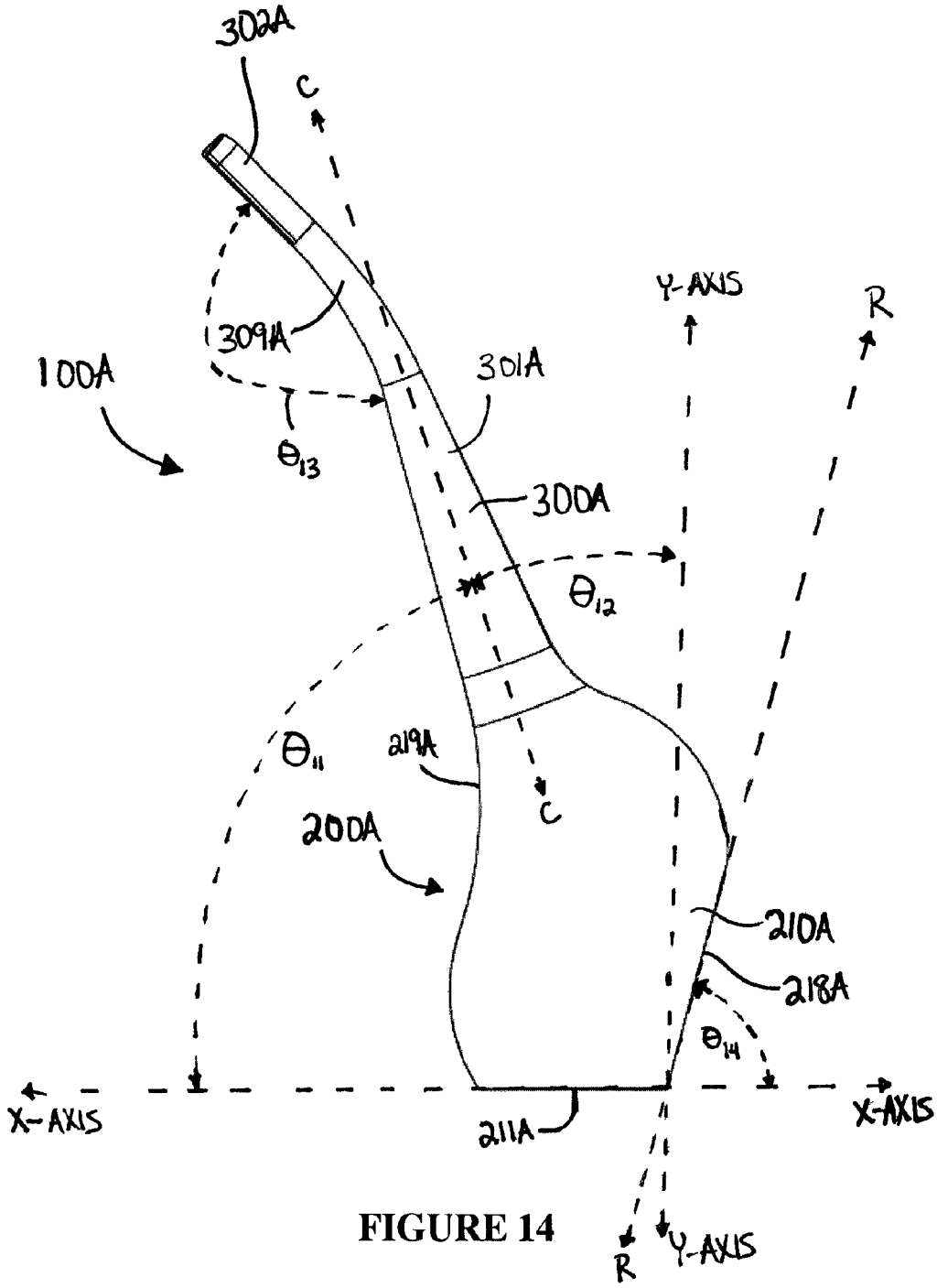
FIG. 14 is a side view of the utensil of FIG. 13 positioned along an X-Y plane of a three-dimensional Cartesian coordinate system.

Referring first to FIGS. 13 and 14, a utensil 100A is illustrated in accordance with an alternative embodiment of the present invention. The utensil 100A comprises a base 200A, a first elongated rod 300A and a second elongated rod 400A. The base 200A facilitates user manipulation of the utensil 100A and is the portion of the utensil 100A that is gripped by a user during use of the utensil 100A. In certain embodiments, the base 200A can be textured to facilitate handling, such as by giving the base 200A a roughened texture, or by overmolding a layer of a thermoplastic elastomer onto the base 200A. Furthermore, the first and second elongated rods 300A, 400A are used for gripping food products or other objects to assist a user in transporting food from a plate to the user's mouth.

The base 200A of the utensil 100A comprises a first body 210A and a second body 220A that are rotatably coupled together by a hinge 500A. The first elongated rod 300A extends from the first body 210A and the second elongated rod 400A extends from the second body 220A. The first body 210A comprises a first bottom surface 211A and the second body 220A comprises a second bottom surface 221A. The first and second bottom surfaces 211A, 221A are substantially planar surfaces, and are substantially coplanar with one another. Thus, the first and second bottom surfaces 211A, 221A collectively define a support plane for the utensil 100A and enables the utensil 100A to be self-standing upon a substantially horizontal support surface, such as a desk, a tabletop, a floor, a shelf, a countertop or the like.

The base 200A of the utensil 100A has a different shape than the base 200 of the utensil 100 discussed above. Specifically, the base 200A of the utensil 100A has a truncated ovoid shape that is truncated at two locations; namely at the bottom surfaces 211A, 221A and along rear surfaces 218A, 228A. The rear surfaces 218A, 228A are angled at an angle of between 10-20°, and more preferably approximately 15° relative to the Y-axis. This tilt angle of the rear surfaces 218A, 228A moves the center of gravity so that it is squarely under the base 200A to improve stability of the utensil 100A. Furthermore, the front surface 219A of the first body 210A of the base 200A has a contoured shape to improve gripability by a user. More specifically, the contoured shape of the front surface 219A of the first body 210A of the base 200A more accurately conforms to the shape of a user's palm for enhanced comfort. Furthermore, it should be appreciated that the front suffice of the second body 220A of the base 200A is contoured similarly to the contoured shape of the front surface 219A of the first body 210A, although not illustrated herein.

The rotation axis R-R is aligned with the rear surfaces 218A, 228A of the first and second bodies 210A, 220A of the base 200A. Furthermore, in the exemplified embodiment, the Y-axis is oriented at an angle of approximately 10-20°, or more specifically 15° relative to the rotation axis R-R as discussed above. The axis of rotation R-R also extends at a first oblique angle $\theta_{14}$ of between 70-80°, and more specifically approximately 75° relative to an x-z plane of the Cartesian coordinate system. Although only the X-axis is illustrated in FIG. 14, the x-z plane is the same as that illustrated in FIG. 5 above. In certain embodiments the Cartesian coordinate system can be shifted so that the axis of rotation R-R extends along the Y-axis of the Cartesian coordinate system, rather than at the oblique angle relative to the x-z plane of the Cartesian coordinate system. Thus, although the axis of rotation R-R is depicted as being oriented at an angle relative to the Y-axis, in certain other embodiments the axis of rotation R-R is oriented at an oblique angle relative to the bottom surfaces 211A, 221A of the first and second bodies 210A, 220A (or relative to the support plane), but coextensive with the Y-axis.

The first and second elongated rods 300A, 400A have a similar shape, size and contour. The first elongated rod 300A will be discussed in detail below, with it being understood that the description below applies equally to the second elongated rod 400A. The first elongated rod 300A can be conceptually divided into a base portion 301A, a transition portion 309A and a distal portion 302A. The transition portion 309A is located in between the base portion 301A and the distal portion 302A. The base portion 301A of the first elongated rod 300A extends along a rod axis C-C. Furthermore, the rod axis C-C forms an angle $\theta_{11}$ with the X-axis and the rod axis C-C forms an angle $\theta_{12}$ with the Y-axis. The angle $\theta_{11}$ is preferably between 60-80°, and more preferably approximately 70° whereas the angle $\theta_{12}$ is preferably between 15-25°, and more preferably approximately 20°. This shape of the utensil 100A is advantageous in that it reduces the need to weight the base 200A. More specifically, the utensil 100A of the shape exemplified in this embodiment is self-supporting without the need for any weighting of the base 200A.

The transition portion 309A extends from the base portion 301A towards the distal portion 302A. The transition portion 309A is curved along its length from the base portion 301A to the distal portion 302A. The distal portion 302A is the portion of the utensil 100A that comprises the nubs 600A. In this exemplified embodiment, the distal portion 302A is not angled relative to the transition portion 309A. However the distal portion 302A is angled relative to the base portion 301A due to the curvature of the transition portion 309A. Specifically, the distal portion 302A is angled at an angle $\theta_{13}$ of between 20-30°, and more preferably between 25-28° relative to the base portion 301A, and therefore relative to the rod axis C-C.

Figure 15:
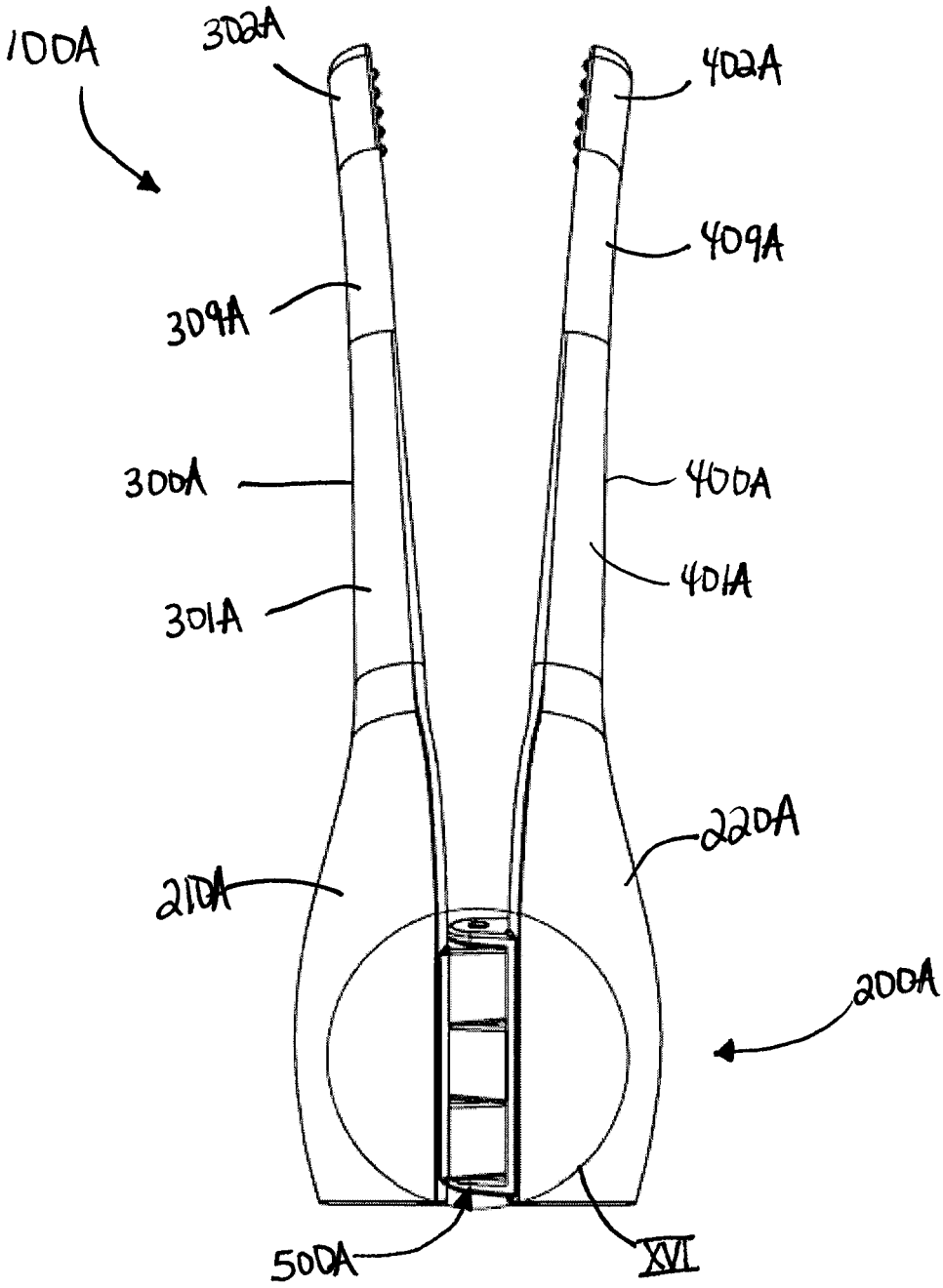
FIG. 15 is a rear view of the utensil of FIG. 13.
Figure 16:
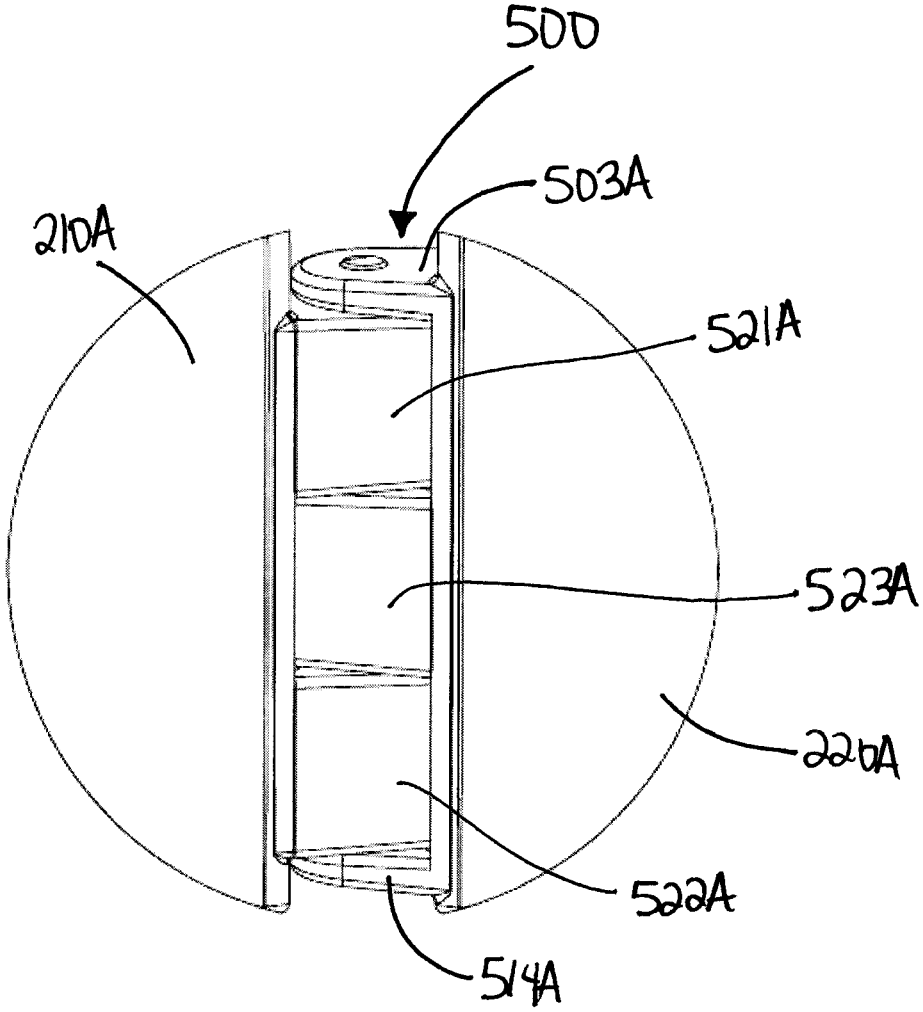
FIG. 16 is a close-up view of area XVI of FIG. 15.
Figure 17:
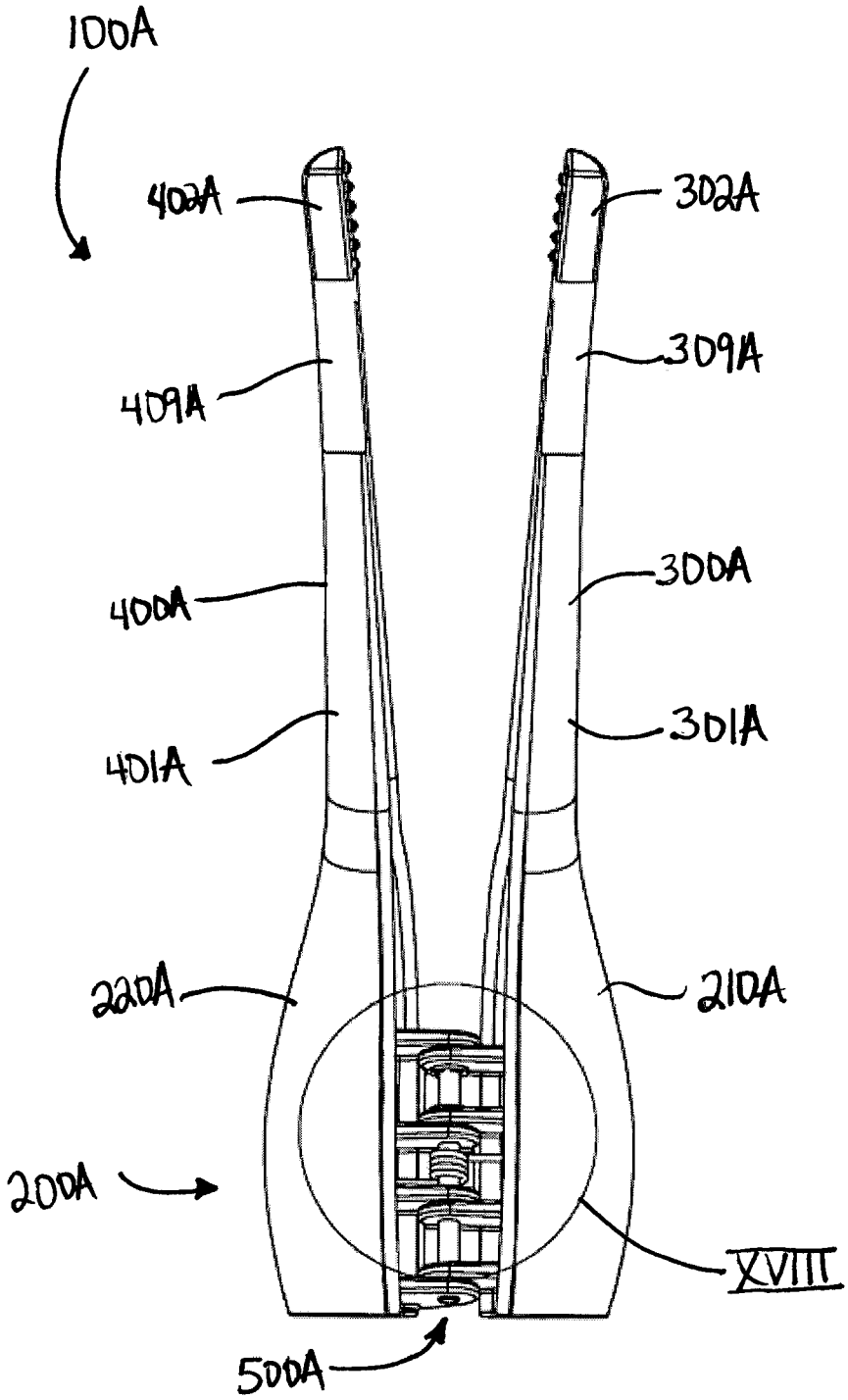
FIG. 17 is a front view of the utensil of FIG. 13.
Figure 18:
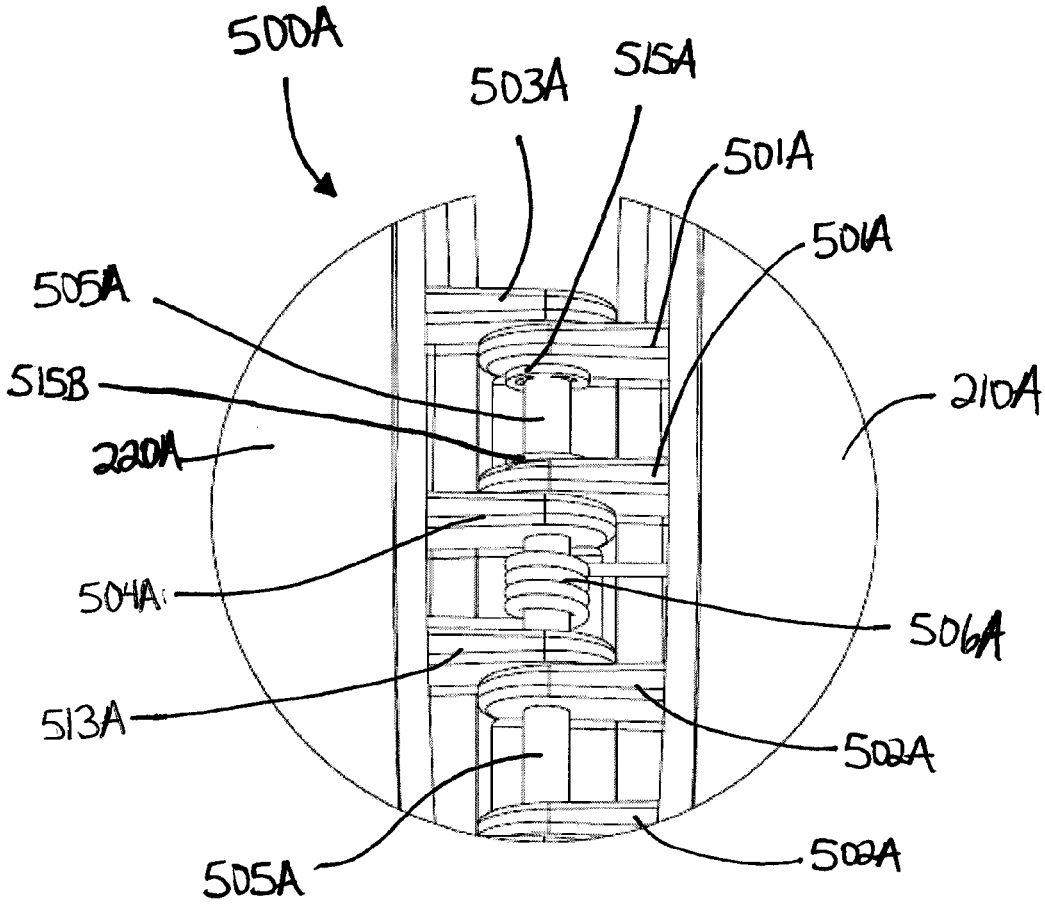
FIG. 18 is a close-up view of area XVIII of FIG. 17.

FIG. 15 is a rear view of the utensil 100A and FIG. 16 is a close-up of area XVI of FIG. 15. Specifically, FIG. 16 illustrates a close-up view of the rear of the hinge 500A of the utensil 100A. FIG. 17 is a front view of the utensil 100A and FIG. 18 is a close-up of area XVII of FIG. 17. Specifically, FIG. 18 illustrates a close-up view of the front of the hinge 500 of the utensil 100A. The differences between the hinge 500A of the utensil 100A and the hinge 500 of the utensil 100 will be discussed in more detail below with reference to FIG. 20.

Figure 19:
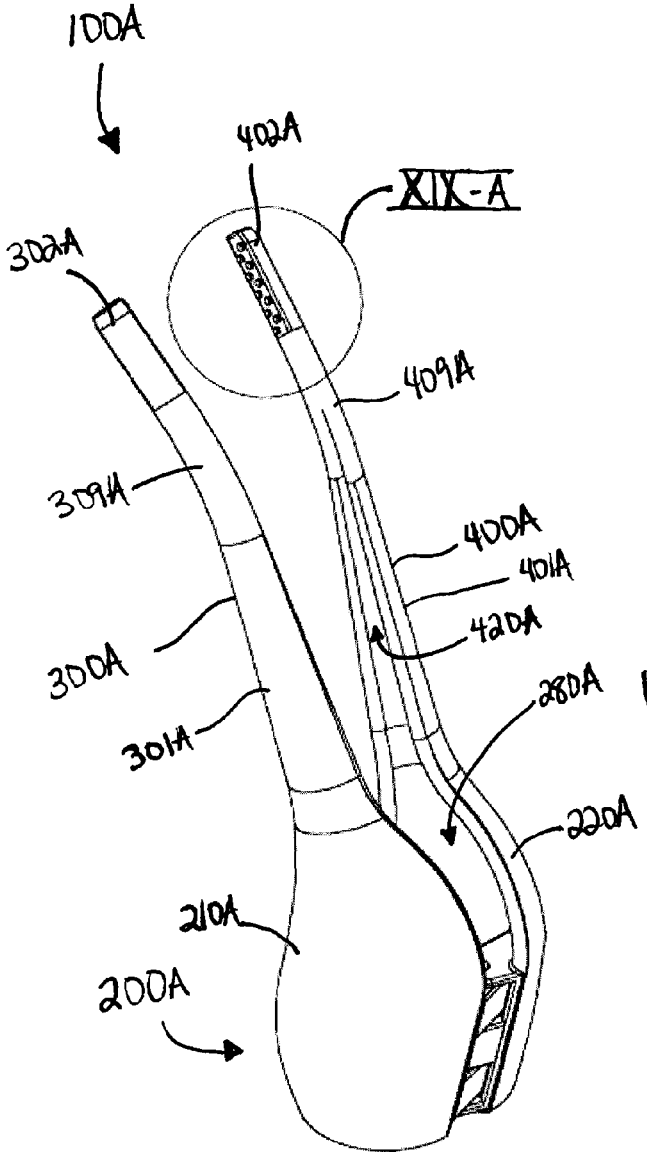
FIG. 19 is a perspective view of the utensil of FIG. 13.

Referring now to FIG. 19, a perspective view of the utensil 100A is illustrated. As can be seen, the interior 280A of the base 200A is hollowed out and open. Furthermore, a channel 420A is formed in the inside surfaces of the second elongated rod 400A. More specifically, the channel 420A is formed into the base portion 401A of the second elongated rod 400A. A channel is also formed in the inside surface of the first elongated rod 300A, but it is not visible in FIG. 19. Thus, the elongated rods 300A, 400A, or at least the base portions 301A, 401A of the elongated rods 300A, 400A, have a C-shaped cross-section. By forming the base portions 301A, 401A of the elongated rods 300A, 400A in this manner, the diameter of the wall of the base portions 301A, 401A is reduced while maintaining structural strength. The channel 420A forms a continuous hollowed out region of the utensil 100A with the interior 280A of the base 200A. Furthermore, in addition to the hollow interior 280A and the channel 420A, it can be seen in FIG. 20 that the bottom end of the first and second bodies 210A, 220A are open. The channel 420A, hollowed out interior 280A and open bottom end reduces the manufacturing costs and assembly time of the utensil 100A by reducing the amount of materials needed to manufacture the device.

Figure 19A:
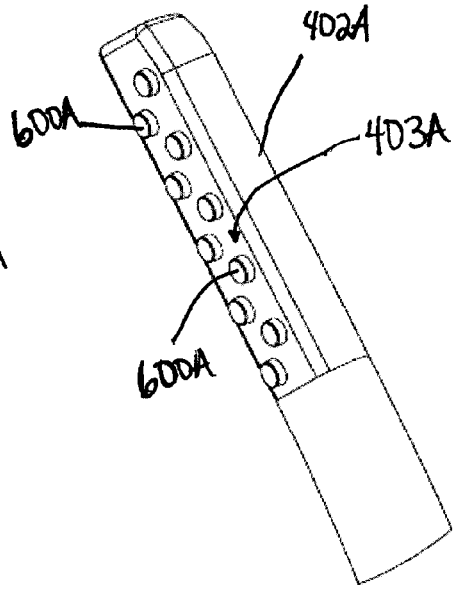
FIG. 19A is a close-up view of area XIX-A of FIG. 19.

Referring to FIG. 19A, a close-up view of the distal end 402A of the second elongated rod 400A is illustrated. Of course, it should be appreciated that the distal end 302A of the first elongated rod 300A is similar in structure to the distal end 402A of the second elongated rod 400A except for any differences discussed herein below. The distal end 402A of the elongated rod 400A comprises nubs 600A extending therefrom, which are similar to the nubs 600 discussed above. The nubs 600A protrude from the inner surface 403A of the distal portion 402A of the second elongated rod 400A and aids in the grasping and holding of food or other objects. In the exemplified embodiment, the nubs 600A are columnar shaped nubs.

In the exemplified embodiment, the nubs 600A are arranged on the inner surface 403A of the distal portion 402A of the second elongated rod 400A in two columns. Furthermore, the nubs 600A in the first one of the columns are offset or staggered relative to the nubs 600A in the second one of the columns. Furthermore, in on preferred embodiment, although not illustrated herein, the nubs 600A are arranged on the inner surface 303A of the distal portion 302A of the first elongated rod 300A in two columns so that the nubs 600A in the first one of the columns are offset or staggered relative to the nubs 600A in the second one of the columns. When the distal ends 302A, 402A of the first and second elongated rods 300A, 400A are brought together, the nubs 600A of the distal end 302A of the first elongated rod 300A will not contact the nubs 600A of the distal end 402A of the second elongated rod 400A. In other words, the nubs 600A of the first elongated rod 300A are oppositely offset relative to the nubs 600A of the second elongated rod 400A to prevent contact between the nubs of the various elongated rods 300A, 400A.

Figure 20:
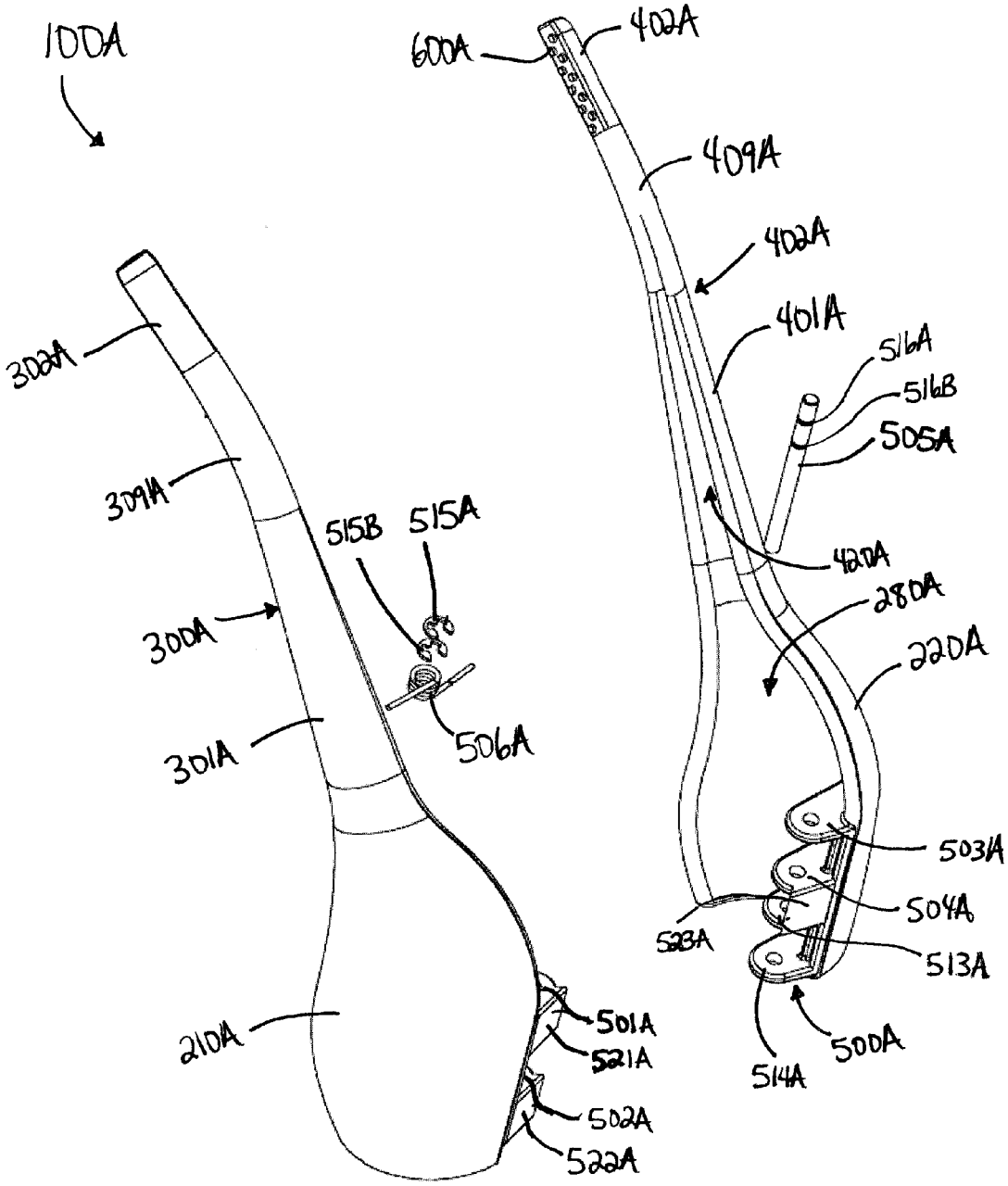
FIG. 20 is an exploded isometric view of the utensil of FIG. 13.

Referring now to FIGS. 16, 18 and 20 concurrently, the utensil 100A will be further described. The discussion below will describe the differences between the hinge 500A relative to the hinge 500 of the utensil 100. The hinge 500A comprises first and second bosses 501A, 502A that extend outwardly from the first body 210A. In the exemplified embodiment, the first boss 501A comprises two separate boss elements that are connected by a wall 521A and the second boss 502A comprises two separate boss elements that are connected by a wall 522A. The hinge 500A also includes third, fourth, fifth and sixth bosses 503A, 504A, 513A, 514A that extend outwardly from the second body 220A. The fourth and fifth bosses 504A, 513A are connected by a wall 523A. The walls 521A, 522A, 523A provide for an aesthetically appealing utensil 100A that hides the resilient element 506A from view when the utensil 100A is fully assembled.

Each of the bosses 501A, 502A, 503A, 504A, 513A, 514A includes an opening therethrough. Furthermore, each of the bosses 501A, 502A, 503A, 504A, 513A, 514A is in the shape of a slender rib, which improves moldability and reduces sinks. Furthermore, the hinge 500A includes a hinge pin 505A, a resilient member 506A and a first and second retaining ring 515A, 515B. The hinge pin 505A comprises first and second recesses 516A, 516B that extend around the circumference of the hinge pin 505A. The retaining rings 515A, 515B are sized and configured to snap fit into the recesses 516A, 516B in the hinge pin 505A in order to prevent the hinge pin 505A from axial movement when the utensil 100A is assembled.

During assembly, the resilient member 506A is positioned in between the fourth and filth bosses 504A, 513A and the hinge pin 505A is inserted into the openings in the bosses and the resilient member 506A. Next, the retaining rings 515A, 516A are snap fit into the recesses 516A, 516B on the hinge pin 506, which are located in between the two first bosses 501A, to retain the hinge pin 505A in place. Thus, assembly of the utensil 100A is similar to the assembly of the utensil 100 discussed above, except that the second body 220A includes additional bosses and the retaining rings 515A, 515B are used to retain the hinge pin 505A in place. Thus, various combinations of the embodiments described herein are within the scope of the present invention.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the embodiment of the present invention has been described with reference to the accompanying drawings, it can be understood by those skilled in the art that the present invention can be embodied in other specific forms without departing from its spirit or essential characteristics. Therefore, the foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A utensil comprising:

a base comprising:

a first body having a first bottom surface; and a second body having a second bottom surface, the second body rotatably coupled to the first body, the first and second bottom surfaces collectively defining a support plane;

a first elongated rod extending from the first body and terminating in a first distal portion;

a second elongated rod extending from the second body and terminating in a second distal portion;

wherein the utensil is weighted to be self-standing so that when the support plane is positioned atop a substantially horizontal support surface, each of the first and second distal portions of the first and second rods are maintained a distance above the substantially horizontal support surface; and wherein the second body is rotatably coupled to the first body so as to be rotatable about an axis of rotation, wherein the axis of rotation extends oblique to the support plane.

2. The utensil of claim 1 wherein the first elongated rod extends along a first rod axis and the second elongated rod extends along a second rod axis, and wherein the first and second rod axes extend at an angle that is oblique to the support plane.

3. The utensil of claim 2 wherein the first elongated rod comprises a first base portion and the first distal portion and the second elongated rod comprises a second base portion and the second distal portion, the first base portion extending coincident with the first rod axis and the first distal portion extending obliquely to the first rod axis, and the second base portion extending coincident with the second rod axis and the second distal portion extending obliquely to the second rod axis.

4. The utensil of claim 1 wherein the first and second bodies can be rotated between an open state in which the first and second distal portions are spaced from one another and a closed state in which the first and second distal portions are in contact with one another.

5. The utensil of claim 4 further comprising a resilient member that biases the first and second bodies into the open state.

6. The utensil of claim 1 wherein the first and second bodies are bulbous blocks.

7. The utensil of claim 1 further comprising:

the first body having a first inner surface;

the second body having a second inner surface that opposes the first inner surface; and a hinge rotatably coupling the first and second bodies together, the hinge located between the first and second inner surfaces.

8. The utensil of claim 1 further comprising:

the first body having a first inner surface;

the second body having a second inner surface that opposes the first inner surface;

a hinge rotatably coupling the first and second bodies together, the hinge located between the first and second inner surfaces;

the first and second bodies rotatable about the axis of rotation between an open state in which the tint and second distal portions are spaced from one another and a closed state in which the first and second distal portions are in contact with one another;

the support plane being substantially coplanar with an x-z plane of the Cartesian coordinate system;

the first elongated rod extending along a first rod axis and the second elongated rod extending along a second rod axis;

the first and second rod axes diverging from one another in the open state; and the first and second rod axes converging with one another in the closed state.

9. A utensil comprising:

a base comprising:

a first block having a first bottom surface; and a second block having a second bottom surface, the second block rotatably coupled to the first block, and the first and second bottom surfaces collectively defining a support plane;

a first elongated rod extending from the first block along a first rod axis;

a second elongated rod extending, from the second block along a second rod axis;

the first and second rod axes extending at an oblique angle relative to the support plane;

wherein the utensil is weighted to be self-standing so that when the support plane is positioned atop a substantially horizontal support surface, no portion of the first and second elongated rods is in contact with the substantially horizontal support surface; and wherein the second block is rotatably coupled to the first block so as to be rotatable about an axis of rotation, wherein the axis of rotation extends oblique to the support plane.

10. The utensil of claim 9 wherein the first elongated rod comprises a first base portion and a first distal portion and the second elongated rod comprises a second base portion and a second distal portion, the first base portion extending coincident with the first rod axis and the first distal portion extending obliquely to the first rod axis, and the second base portion extending coincident with the second rod axis and the second distal portion extending obliquely to the second rod axis.

11. A utensil comprising:

a base comprising:

a first body; and a second body;

a first elongated rod extending from the first body;

a second elongated rod extending from the second body;

wherein the second body is rotatably coupled to the first body so as to be rotatable about an axis of rotation, the axis of rotation extending along a y-axis of a Cartesian coordinate system;

wherein the first elongated rod extends along a first rod axis and the second elongated rod extending along a second rod axis, each of the first and second rod axes extending at an angle that is oblique to an x-z plane, an x-y plane and a y-z plane of the Cartesian coordinate system; and wherein the first elongated rod comprises a first base portion and a first distal portion and the second elongated rod comprises a second base portion and a second distal portion, the first base portion extending coincident with the first rod axis and the first distal portion extending obliquely to the first rod axis, and the second base portion extending coincident with the second rod axis and the second distal portion extending obliquely to the second rod axis.

12. A utensil comprising:

a base comprising:

a first block having a first bottom surface;

a second block having a second bottom surface, the first and second bottom surfaces collectively defining a support plane that is substantially coplanar with an x-z plane of a Cartesian coordinate system; and a hinge rotatably coupling the first and second blocks together for rotation about an axis of rotation, the axis of rotation extending at a first oblique angle to an x-z plane of the Cartesian coordinate system;

a first elongated rod extending from the first block along, a first rod axis;

a second elongated rod extending from the second block along a second rod axis; and the first and second axes extending at a second oblique angle to the x-z plane of the Cartesian coordinate system; and the elongated rods located on a first side of the x-z plane and the hinge located one second side of the x-z plane opposite the first side.

13. The utensil of claim 12 wherein the wherein the first and second rod axes diverge from one another with positive distance from the x-plane.

14. The utensil of claim 12 wherein the utensil is weighted to be self-standing so that when the support plane is positioned atop a substantially horizontal support surface, each of the first and second distal portions of the first and second elongated rods are maintained a distance above the substantially horizontal support surface.

* * * * *